US005962182A

United States Patent [19]

Katoh et al.

[11] Patent Number: 5,962,182

[45] Date of Patent: Oct. 5, 1999

[54] IMAGE FORMING METHOD

[75] Inventors: Kazunobu Katoh; Shinnichi Morishima, both of Kanagawa, Japan

[73] Assignee: Fuji Photo Film Co., Ltd., Kanagawa, Japan

[21] Appl. No.: 08/822,645

[22] Filed: Mar. 24, 1997

Related U.S. Application Data

[63] Continuation of application No. 08/559,491, Nov. 15, 1995, abandoned.

[30] Foreign Application Priority Data

Nov. 17, 1994 [JP] Japan ..... 6-307056

[51] Int. Cl.[6] ..... G03C 5/29

[52] U.S. Cl. ..... 430/264; 430/405; 430/440; 430/446; 430/448; 430/566

[58] Field of Search ..... 430/405, 448, 430/505, 566, 440, 446, 264

[56] References Cited

U.S. PATENT DOCUMENTS

| | | | |
|---|---|---|---|
| H1508 | 12/1995 | Hirano | 430/440 |
| 4,725,532 | 2/1988 | Kameoka et al. | 430/566 |
| 4,839,258 | 6/1989 | Katoh | 430/264 |
| 5,236,816 | 8/1993 | Purol et al. | 430/492 |

FOREIGN PATENT DOCUMENTS 93 11456 6/1993 WIPO .

*Primary Examiner*—Hoa Van Le

*Attorney, Agent, or Firm*—Sughrue, Mion, Zinn, Macpeak & Seas, PLLC

[57] ABSTRACT

A method for forming an image which comprises imagewise-exposing a silver halide photographic material comprising a support having thereon at least one silver halide emulsion layer, wherein the emulsion layer or other hydrophilic colloid layer contains a hydrazine derivative as a nucleating agent and contains at least one compound represented by formula (A); and then developing the exposed photographic material with a developer having a pH of 9.0 to 11.0 which contains an ascorbic acid type developing agent and does not substantially contain a dihydroxybenzene type developing agent:

(A)

wherein X represents a hydrogen atom, an aryl group, a heterocyclic group, or a group represented by formula (B):

(B)

wherein each of $R_1$, $R_2$ and $R_3$ may be the same or different, and each represents a hydrogen atom or a group other than a hydroxyl group.

8 Claims, No Drawings

IMAGE FORMING METHOD

This is a Continuation of application Ser. No. 08/559,491 filed Nov. 15, 1995, abandoned.

FIELD OF THE INVENTION

The present invention relates to a method for forming an image by use of a silver halide photographic material, and particularly, to a method for forming a super-high content negative type image which is used for a photomechanical process.

BACKGROUND OF THE INVENTION

Methods for forming a high contrast image by using hydrazine derivatives are well known and have been widely used for a photomechanical process. However, the developers used for the process generally require high pH and therefore are easily subjected to aerial oxidation, which causes the developers to be unstabilized.

Attempts have been made to develop silver halide photographic materials containing hydrazine compounds with developers of lower pH to form a high contrast image.

A process for developing a sensitive material which contains a nucleating accelerator having an adsorbing group for silver halide emulsion grains and simultaneously a nucleating agent having an adsorbing group with a developer having a pH of 11.0 or lower is described in JP-A-1-179939 (The term "JP-A" as used herein means an "unexamined published Japanese patent application") and JP-A-1-179940. However, when the adsorbing group-containing compounds exceeding a certain amount are added to a silver halide emulsion, the compounds have the disadvantage of deteriorating the photosensitivity, of controlling development, and of preventing the effects of other useful adsorbent additives. The usage of the compounds is therefore limited, thus failing to produce sufficiently high contrast.

U.S. Pat. Nos. 4,998,604 and 4,994,365 have disclosed a hydrazine compound having a repeating unit of ethylene oxide and a hydrazine compound having a pyridinium group. However, as is apparent from the examples of these patents, the resulting sensitive materials are difficult to afford sufficiently high contrast property and desired $D_{max}$ under the practical conditions of development.

Further, nucleating high contrast sensitive materials containing hydrazine compounds have wide variation in photographic properties with change in pH of a developer. The pH of developers largely changes, because the pH increases by aerial oxidation and concentration of the developers owing to evaporation of water, or decreases by absorption of carbon dioxide in air. Hence, attempts have been made to reduce the dependence of photographic performance upon the pH of developers.

As mentioned above, in the prior art, sensitive materials having sufficiently high contrast and little dependence of photographic performance on the pH of the developers cannot be obtained even if the materials are processed with developers having a pH of less than 11.

Sensitive materials containing hydrazine derivatives and reductones are disclosed in JP-B-6-68615 (The term "JP-B" as herein means an "examined Japanese patent publication") The developers contain dihydroxybenzenes, 3-pyrazolidones and aminophenols and are adjusted to pH 10.5 to pH 12.3. However, in this method for forming an image, high contrast although the reductones had a preventive action on generation of black peppers, acceleration of increase of contrast could not be obtained even if the reductones was used.

SUMMARY OF THE INVENTION

An object of the present invention is to provide a method for forming a silver halide photographic image which secures extremely high contrast photographic properties of negative gradation exhibiting γ exceeding 10 by use of a stable developer.

Another object of the present invention is to provide a method for forming a super-high contrast image at pH 11.0 or lower by use of an ascorbic acid-containing developer which does not contain a dihydroxybenzene type developing agent.

The above-mentioned objects of the present invention have been accomplished by a method for forming an image which comprises imagewise-exposing a silver halide photographic material comprising a support having thereon at least one silver halide emulsion layer wherein the emulsion layer or other hydrophilic colloid layer contains a hydrazine derivative as a nucleating agent and contains at least one compound represented by formula (A), and then developing the exposed photographic material with a developer having a pH of 9.0 to 11.0 which contains ascorbic acid as a developing agent and a superadditive auxiliary developing agent and does not substantially contain a dihydroxybenzene type developing agent:

(A)

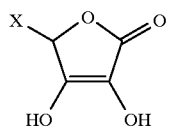

wherein X represents a hydrogen atom, an aryl group, a heterocyclic group, or a group represented by formula (B):

(B)

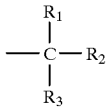

wherein each of $R_1$, $R_2$ and $R_3$ each may be the same or different, and each represents a hydrogen atom or a group other than a hydroxyl group.

DETAILED DESCRIPTION OF THE INVENTION

The formula (A) is described in more detail below.

In formula (A), an aryl group represented by X is one having 6 to 10 carbon atoms such as a phenyl group or a naphthyl group. The aryl group preferably contains a substituent group. Examples of the substituent group include an alkyl group, an alkenyl group, an aryl group, a halogen atom, a nitro group, a hydroxyl group, an alkoxyl group, an aryloxy group, an alkylthio group, an arylthio group, an acyloxy group, an amino group, an alkylamino group, a carbonamido group, a sulfonamido group, a ureido group, an acyl group, an oxycarbonyl group, a carbamoyl group, a sulfinyloxy group, a carboxyl group and its salts, a sulfo group and its salts, and a hydroxyamino group. Examples of the aryl group represented by X include p-methylphenyl, p-bromophenyl, anisyl, p-carboxyphenyl, and p-sulfonylphenyl.

In formula (A), a heterocyclic group represented by X is a 5- or 6-membered ring formed of a carbon atom, a nitrogen atom, an oxygen atom or a sulfur atom. Examples of the heterocyclic group include a furyl group, a benzofuryl group, a pyranyl group, a pyrrolyl group, an imidazolyl group, a pyrazolyl group, a triazolyl group, a pyridyl group, a pyrimidyl group, a pyridazyl group, a thienyl group, and an isothiazolyl group. These groups may contain a substituent group. Examples of the substituent group are the same as those described for the above aryl group. Examples of preferred heterocyclic groups include furyl, 5-methylfuryl, benzofuryl, pyridyl, 5-chloropyridyl, 3-carboxypyridyl, 5-sulfonylpyridyl, and 1-phenyltriazolyl.

$R_1$, $R_2$ and $R_3$ in the group represented by formula (B) are described in more detail below.

$R_1$, $R_2$ and $R_3$, each may be the same or different, and each represents a hydrogen atom or a substituent group other than a hydroxyl group. Examples of $R_1$, $R_2$ and $R_3$ include an alkyl group, an aryl group, an alkoxyl group, an aryloxy group, an alkylthio group, an aryloxy group, an acyloxy group, an amino group, an alkylamino group, a carbonamido group, a sulfonamido group, a ureido group, an oxycarbonyl group, a carbamoyl group, a sulfinyloxy group, a carboxyl group and its salts, and a sulfo group and its salts. These groups may further contain a substituent group, if necessary. Examples of the substituent group are the same as those described for the above aryl group represented by X of formula (A).

Examples of the groups, $R_1$, $R_2$ and $R_3$, are shown in great detail.

The alkyl group is a straight-chain, branched-chain, or cyclic alkyl group containing 1 to 16 carbon atoms, and preferably 1 to 6 carbon atoms. The alkyl group may further contain a substituent group. Examples of the substituent group are the same as those described for the above aryl group represented by X of formula (A). Examples of the alkyl group include methyl, ethyl, propyl, isopropyl, butyl, t-butyl, cyclohexyl, benzyl, hydroxymethyl, heptyloxymethyl, phenoxymethyl, octylthiomethyl, phenylthiomethyl, octanoyloxylmethyl, 1,2-dioctanoyloxyethyl, 1,2,3-tridecanoyloxypropyl, aminomethyl, dimethylaminomethyl, octanoylamidomethyl, methanesulfonylamidomethyl, ureidomethyl, undecyloxycarbonylmethyl, carbamoylmethyl carboxymethyl, and sulfonylmethyl.

The aryl group has 6 to 10 carbon atoms. The group may contain a substituent group. Examples of the substituent group are the same as those described for the above aryl group represented by X of formula (A). Examples of the aryl group include phenyl, naphthyl, and p-methylphenyl.

The alkoxyl group has 1 to 19 carbon atoms, and preferably 7 to 19 carbon atoms. The group may contain a substituent group. Examples of the substituent group are the same as those described for the above aryl group represented by X of formula (A). Examples of the alkoxyl group include methoxy, ethoxy, propoxy, hexyloxy, heptyloxy, octyloxy, dodecyloxy, octadecyloxy, and 2-methoxyethoxy.

The aryloxy group has 6 to 10 carbon atoms. The group may contain a substituent group. Examples of the substituent group are the same as those described for the aryl group represented by X of formula (A). Examples of the aryloxy group include phenoxy, p-hydroxyphenoxy, o-carboxyphenoxy, and o-sulfonylphenoxy.

The alkylthio group has 1 to 16 carbon atoms, and preferably 7 to 16 carbon atoms. The group may contain a substituent group. Examples of the substituent group are the same as those described for the above aryl group represented by X of formula (A). Examples of the alkylthio group include methylthio, octylthio and dodecylthio.

The arylthio group has 6 to 10 carbon atoms. The group may contain a substituent group. Examples of the substituent group are the same as those described for the above aryl group represented by X of formula (A). Examples of the arylthio group include phenylthio, 4-hydroxyphenylthio and 4-octyloxyphenylthio.

The acyloxy group has 1 to 19 carbon atoms, and preferably 7 to 19 carbon atoms. The group may contain a substituent group. Examples of the substituent group are the same as those described for the aryl group represented by x of formula (A). Examples of the acyloxy group include acetoxy, octanoyloxy, hexadecanoyloxy, carboxyacetoxy, and 2-sulfonyl-hexadecanoyloxy. sulfonyl-hexadecanoyloxy.

The alkylamino group has 1 to 16 carbon atoms. Examples of the alkylamino group includes dimethylamino and diethylamino.

The carbonamido group has 1 to 16 carbon atoms. Examples of the carbonamido group include acetamido and propionamido.

The sulfonamido group has 1 to 16 carbon atoms. Examples of the sulfonamido group include a methanesulfonamido group.

The ureido group has 1 to 16 carbon atoms. Examples of the ureido include ureido and methylureido.

The oxycarbonyl group has 1 to 16 carbon atoms. Examples of the oxycarbonyl group include methoxycarbonyl, ethoxycarbonyl and undecyloxycarbonyl.

The carbamoyl group has 1 to 16 carbon atoms. Examples of the carbamoyl group include carbamoyl and N,N-dimethylcarbamoyl.

The sulfinyloxy group has 1 to 16 carbon atoms. Examples of the sulfinyloxy group include a methanesulfinyloxy group. The above groups may further be substituted, if desired.

Examples of the groups preferred as $R_1$, $R_2$ and $R_3$ represented by the above-mentioned formula (B) include a hydrogen atom, an alkyl group, an alkoxyl group, an aryloxy group, an alkylthio group, an acyloxy group, an oxycarbonyl group, and a sulfinyloxy group.

Among compounds represented by formula (A), particularly preferred compounds are those represented by formula (C):

(C)

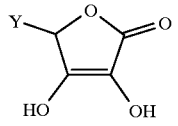

wherein Y represents a group represented by formula (D):

(D)

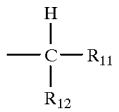

wherein $R_{11}$ and $R_{12}$, each may be the same or different and each represents a hydrogen atom, an alkyl group, an alkoxyl group, an acyloxy group or an oxycarbonyl group.

Preferred combinations of $R_{11}$ and $R_{12}$ of the formula (D) are those of $R_{11}$ selected among a hydrogen atom, an alkoxyl group and an acyloxy group and $R_{12}$ selected among a hydrogen atom, an alkyl group and an oxycarbonyl group.

In these combinations, the alkyl group represented by $R_{12}$ may contain another substituent group, and more preferred alkyl groups are those substituted by an alkoxyl group or an acyloxy group, which may further be substituted, if desired.

A more preferred combination consists of $R_{11}$ that is an alkoxyl group or an acyloxy group and $R_{12}$ that is an alkyl group substituted by an alkoxyl group or an acyloxy group. It is particularly preferred that the alkoxyl group and acyloxy group each has 7 to 19 carbon atoms and the alkyl group has 1 to 6 carbon atoms. It is most preferred that the alkyl group represented by $R_{12}$ is a methyl group. These groups may further contain a substituent group, if desired. Examples of the substituent group are the same as those described for the above aryl group represented by X of formula (A).

Among the compounds represented by formula (C), most preferred compounds are those represented by formula (E):

(E)

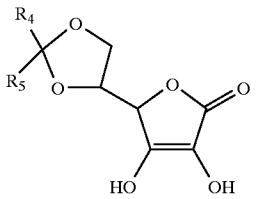

wherein $R_4$ and $R_5$, each may be the same or different and each represents a hydrogen atom, an alkyl group, an aryl group, and an alkenyl group; the alkyl groups represented by $R_4$ and $R_5$ may combine to form a cyclic structure. The alkyl group, aryl group and alkenyl group, each may contain a substituent group. Examples of the substituent group include an alkyl group, an alkenyl group, an aryl group, a halogen atom, a nitro group, a hydroxyl group, an alkoxyl group, an acyl group, a carboxyl group and its salts, a sulfo group and its salts, and a hydroxyamino group.

$R_4$ and $R_5$ in the compounds represented by formula (E) are preferably a hydrogen atom, an alkyl group having 6 to 18 carbon atoms, an aryl group having 6 to 10 carbon atoms, and an alkenyl group having 6 to 18 carbon atoms, more preferably a hydrogen atom, an alkyl group having 6 to 18 carbon atoms, or an aryl group having 6 to 10 carbon atoms, and most preferably a hydrogen atom or an alkyl group having 6 to 18 carbon atoms. The alkyl groups represented by $R_4$ and $R_5$ may combine to form a cyclic structure, and it is more preferred that at least one of $R_4$ and $R_5$ is not a hydrogen atom. These groups may contain a substituent group. Examples of the substituent group are the same as those described in formula (E). For example, $R_4$ and $R_5$ include a hydrogen atom, a methyl group, a ethyl group, a propyl group, a heptyl group, a undecyl group, a benzyl group, a phenyl group, a chloromethyl group, a methoxymethyl group, a 2-methoxyethyl group, an 1-hydroxyamino-1-methylethyl group, and a 9-decenyl group, and a cyclopentyl ring and a cyclohexyl ring that alkyl groups represented by $R_4$ and $R_5$ are combined. These groups may further be substituted, if desired.

Although the compounds represented by formula (A) are described as enol type compounds, keto type compounds isomerized are the same as the enol type compounds. It should be understood that the compounds isomerized by shifting of a hydrogen atom also are included in the scope of the claims of the present invention.

Examples of the compounds represented by formula (A) are shown below. However, in the present invention, the compounds are not limited to these examples.

A-1

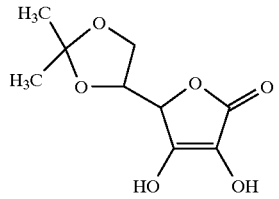

A-2

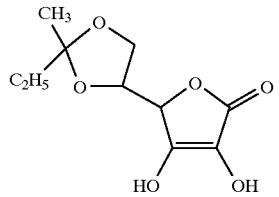

A-3

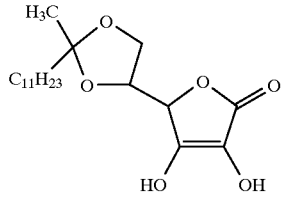

A-4

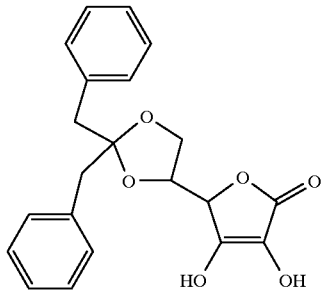

A-5

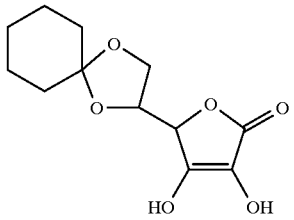

A-6

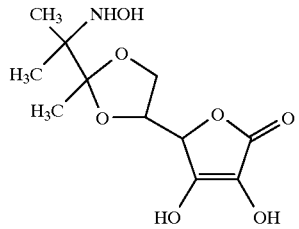

-continued
A-7
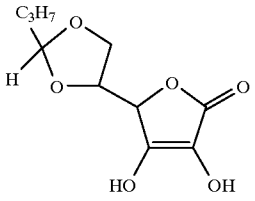
A-8
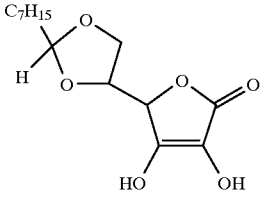
A-9
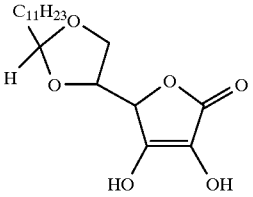
A-10
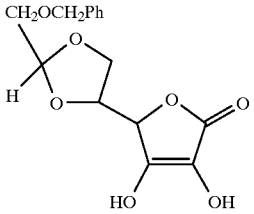
A-11
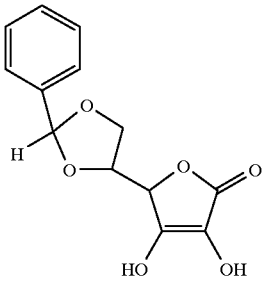
A-12
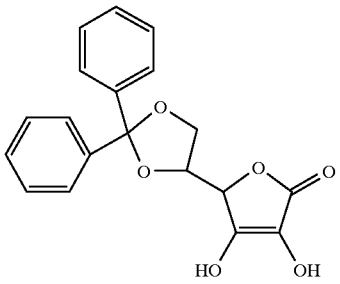
-continued
A-13
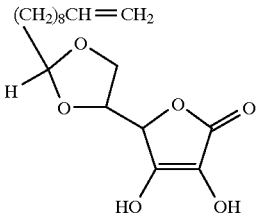
A-14
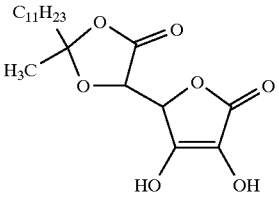
A-15
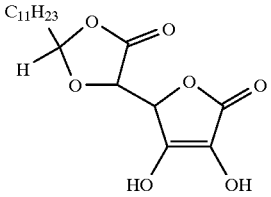
A-16
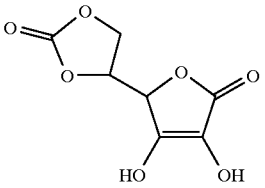
A-17
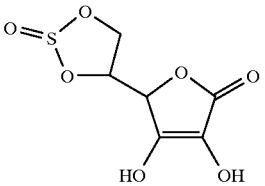
A-18
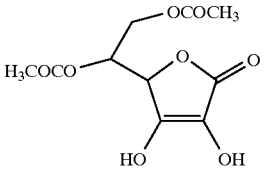
A-19
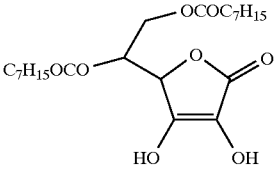
A-20
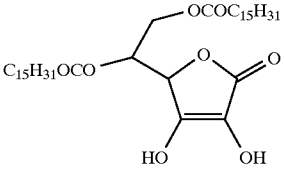

-continued
A-21
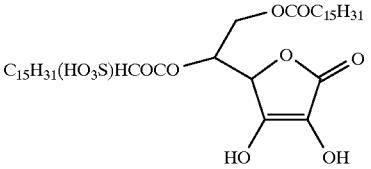
A-22
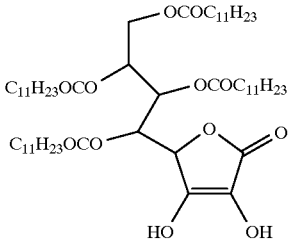
A-23
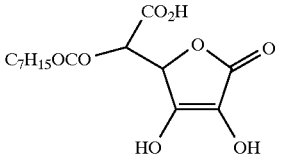
A-24
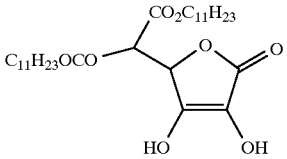
A-25
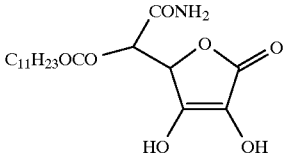
A-26
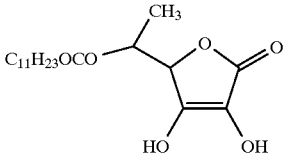
A-27
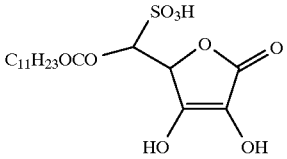
A-28
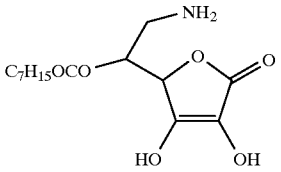
-continued
A-29
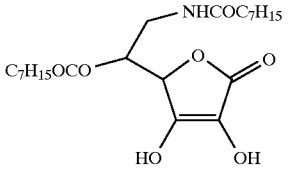
A-30
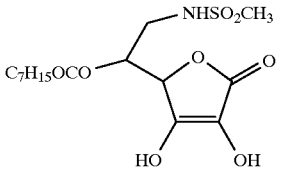
A-31
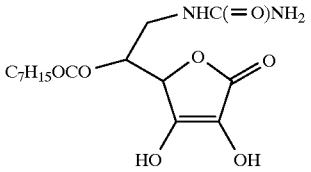
A-32
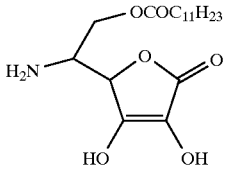
A-33
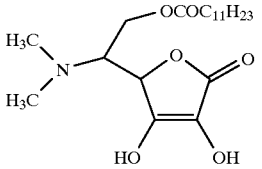
A-34
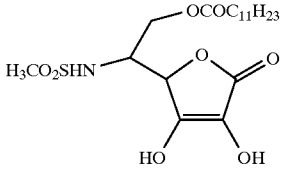
A-35
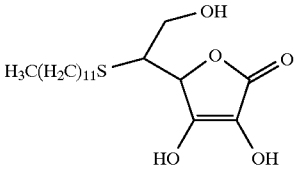
A-36
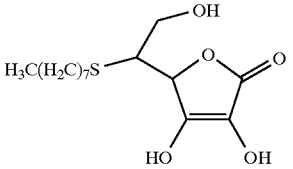

-continued
A-37
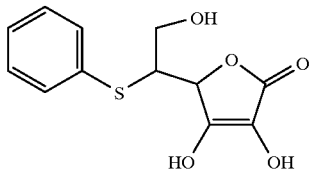
A-38
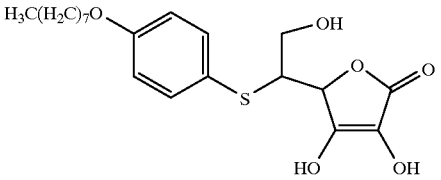
A-39
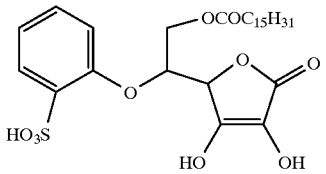
A-40
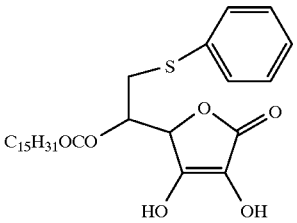
A-41
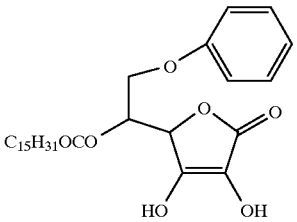
A-42
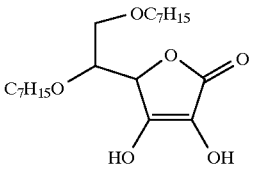
A-43
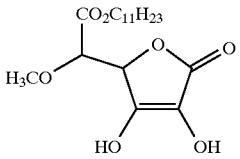
A-44
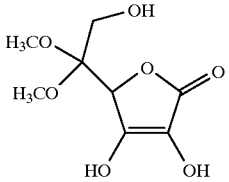
-continued
A-45
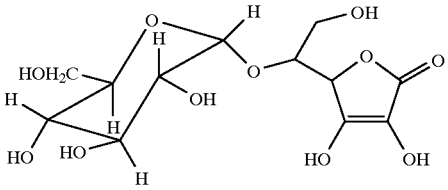
A-46
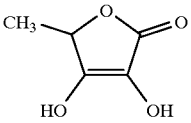
A-47
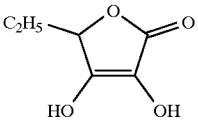
A-48
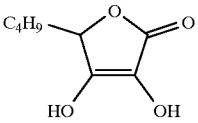
A-49
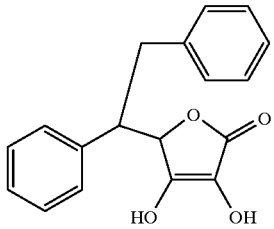
A-50
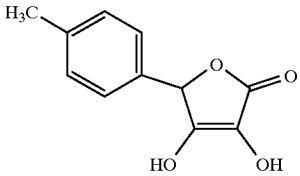
A-51
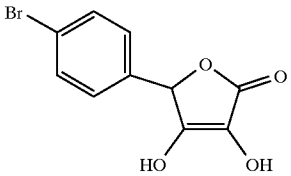
A-52
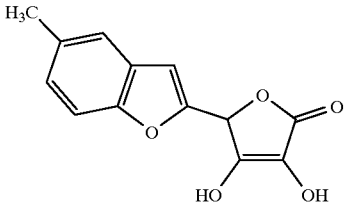

-continued

A-53

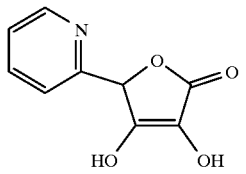

A-54

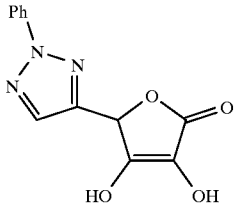

A-55

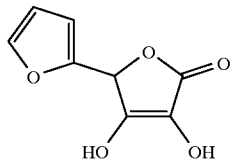

The compounds represented by formula (A) can be prepared according to general methods which are described in H. Tanaka and K. Yamamoto, *Yakugaku Zasshi,* vol. 86(5), 376–383, E. S. H. El. Ashry, A. Mousaad, and N. Rashed, *Advances in Heterocyclic Chemistry,* vol. 53, 233–302, JP-A-64-45383, JP-A-2-288872, JP-A-4-29985, JP-A-4-364182, and JP-A-5-112594.

In the present invention, the content of the compound represented by formula (A) is preferably from $1\times10^{-4}$ to 1 mol per mol of silver halide, and particularly preferably from $1\times10^{-3}$ to 0.5 mol per mol of silver halide.

To use the compound represented by formula (A) of the present invention, the compound is dissolved in an organic water-miscible solvent such as alcohols (for example, methanol, ethanol, propanol, and fluorinated alcohols), ketones (for example, acetone and methyl ethyl ketone), dimethylformamide, dimethylsulfoxide, and methyl cellosolve. Further, according to a method well-known as emulsification dispersion, the compound is dissolved in an oil such as dibutyl phthalate, tricresyl phosphate, glyceryl triacetate, and diethyl phthalate by use of a co-solvent such as ethyl acetate and cyclohexanone followed by preparing mechanically an emulsified dispersion. Or, according to a method known as solid dispersion, a powdered hydrazine derivative can be dispersed in water by use of a ball mill or a colloid mill, or through a ultrasonic wave.

The compound represented by formula (A) of the present invention is added to an emulsion layer or the other hydrophilic colloid layer (a hydrophilic colloid layer formed between the emulsion layer and a support, a surface-protecting layer, or an interlayer formed between the surface-protecting layer and the emulsion layer).

Preferred hydrazine derivatives used in the present invention are compounds represented by the following formula (I):

$$R_1—NHNH—G_1—R_2 \quad (I)$$

wherein $R_1$ represents an aliphatic group, an aromatic group, or a heterocyclic group; $R_2$ represents a hydrogen atom or a blocking group; $G_1$ represents a linkage such as —CO—, —$SO_2$—, —SO—, —CO—CO—, thiocarbonyl, iminomethylene, or —P(O)$R_3$—; $R_3$ is selected among the groups defined as $R_2$ and may be different from $R_2$.

In formula (I), a preferred aliphatic group represented by $R_1$ is an alkyl group having 1 to 30 carbon atoms, and particularly preferably a straight-chain, branched-chain, or cyclic alkyl group having 1 to 20 carbon atoms. A saturated heterocyclic group having 1 or more heteroatom therein also may be included in the branched-chain alkyl group. Further, this alkyl group may contain a substituent group.

In formula (I), the aromatic group represented by $R_1$ is a monocyclic or bicyclic aryl group or an unsaturated heterocyclic group. The unsaturated heterocyclic group may be a heterocyclic aryl group fused together with a monocyclic or bicyclic aryl group. Examples of such the aromatic rings include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothaizole ring. Among these, aromatic rings containing a benzene ring are preferred.

Particularly preferably $R_1$ is an aryl group.

The aliphatic groups or aromatic group represented by $R_1$ may contain a substituent group. Examples of typical substituent groups include an alkyl group, an alkenyl group, an alkynyl group, an aryl group, a group containing a heterocycle, a pyridinium group, a hydroxyl group, an alkoxyl group, an aryloxy group, an acyloxy group, an alkyl- or aryl-sulfonyloxy group, an amino group, a carbonamido group, a sulfonamido group, a ureido group, a thioureido group, a semicarbazido group, a thiosemicarbazido group, a urethane group, a group containing a hydrazine structure, a group containing a quaternary ammonium structure, an alkyl- or aryl-thio group, an alkyl- or aryl-sulfonyl group, an alkyl- or aryl-sulfinyl group, a carboxyl group, a sulfo group, an acyl group, an alkoxyl- or aryloxy-carbonyl group, a carbamoyl group, a sulfamoyl group, a halogen atom, a cyano group, a phosphoric acid amido group, a diacylamino group, an imido group, a group containing an acylurea structure, a group containing a selenium atom or a tellurium atom, and a group containing a tertiary sulfonium structure or a quaternary sulfonium structure. Among these, preferred substituent groups are an straight-chain, branched-chain, or cyclic alkyl group (preferably having 1 to 20 carbon atoms), an aralkyl group (preferably its alkyl moiety having 1 to 3 carbon atoms and its aromatic moiety being a monocyclic or bicyclic group), an alkoxyl group (preferably having 1 to 20 carbon atoms), a substituted amino group (preferably substituted by an alkyl group containing 1 to 20 carbon atoms), an acylamino group (preferably having 2 to 30 carbon atoms), a sulfonamido group (preferably having 1 to 30 carbon atoms), a ureido group (preferably having 1 to 30 carbon atoms), a phosphoric acid amido group (preferably having 1 to 30 carbon atoms), and so forth.

Examples of the blocking group represented by $R_2$ include an alkyl group, an aryl group, a unsaturated heterocyclic group, an alkoxyl group, an aryloxy group, an amino group, and a hydrazino group.

In formula (I), the alkyl group represented by $R_2$ preferably has 1 to 4 carbon atoms, and the aryl group preferably is a monocyclic or bicyclic aryl group which, for example, includes a group having a benzene ring such as a phenyl group.

The unsaturated heterocyclic group is a 5- or 6-membered cyclic group containing at least one of a nitrogen atom, an oxygen atom, and a sulfur atom. Examples of the unsaturated heterocyclic group include an imidazolyl group, a pyrazolyl group, a triazolyl group, a tetrazolyl group, a pyridyl group, a pyridinium group, a quinolinium group, and a quinolyl group. The pyridyl group and pyridinium group are particularly preferred.

The alkoxyl groups preferably contain 1 to 8 carbon atoms, and preferred aryloxy groups are monocyclic. The amino groups preferably are an unsubstituted amino group, an alkylamino group having 1 to 10 carbon atoms, and an arylamino group.

The group represented by $R_2$ may contain a substituent group. Preferred examples of the substituent group are the same as those described for $R_1$.

When $G_1$ is a linkage —CO—, examples of preferred groups represented by $R_2$ include an alkyl group (for example, methyl, trifluoromethyl, 3-hydroxypropyl, 3-methanesulfonamidopropyl, phenylsulfonylmethyl), an aralkyl group (for example, o-hydroxybenzyl), and an aryl group (for example, phenyl, 3,5-dichlorophenyl, o-methanesulfonamidophenyl, 4-methanesulfonylphenyl, 2-hydroxymethylphenyl). A hydrogen atom and a trifluoromethyl group are particularly preferred.

When $G_1$ is a linkage —$SO_2$—, $R_2$ preferably is an alkyl group (for example, methyl), an aralkyl group (for example, o-hydroxybenzyl), an aryl group (for example, phenyl), or a substituted amino group (for example, dimethylamino).

When $G_1$ is a linkage —COCO—, $R_2$ preferably is an alkoxyl group, an aryloxy group and an amino group.

As $G_1$ of formula (I), the linkages —CO— and —COCO— are preferred, and the linkage —CO— is most preferred.

$R_2$ may give rise to a cyclization reaction to form a cyclic structure containing atoms which constitute a $G_1$-$R_2$ moiety cut off from the residual molecule. Examples thereof are described in JP-A-63-29751.

The substituent groups for $R_1$ and $R_2$ may contain additional substituent groups which are the same as those described as the substituent groups for $R_1$. The additional substituent groups may contain further another substituent groups, and the substituent groups for $R_1$ and $R_2$ may ultimately contain multiple substituent groups. Preferred substituent groups are those which are described as the substituent groups for $R_1$.

A ballasting group used commonly in immovable photographic additives such as couplers or a polymer may be incorporated into $R_1$ or $R_2$ of formula (I). The ballasting group is a group having 8 or more carbon atoms, which is relatively inactive for photographic properties. The group can be selected among an alkyl group, an aralkyl group, an alkoxyl group, a phenyl group, an alkylphenyl group, a phenoxy group, an alkylphenoxy group, and so forth. Examples of the polymer include those which are described in JP-A-1-100530.

Groups which increase adsorption on the surfaces of silver halide grains may be incorporated into $R_1$ or $R_2$ of formula (I). Examples of such adsorbing groups include an alkylthio group, an arylthio group, a thiourea group, a heterocyclic thioamido group, a mercapto-heterocyclic group, and a triazolyl group, which are described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

Particularly preferred hydrazine derivatives used in the present invention are those which contain, as $R_1$, a ballasting group, a group promoting adsorption on the surfaces of silver halide grains, a group having a quaternary ammonium structure, or a phenyl group containing an alkylthio group, these groups linking to $G_1$ via a sulfonamido group, an acylamino group, or a ureido group; as $G_1$, a linkage —CO— or —COCO—; and as $R_2$, a substituted alkyl group or a substituted aryl group (preferably substituted by an electron attractive group or by a hydroxymethyl group at the 2-position). It is possible to preferably utilize all combinations of $R_1$ and $R_2$ which are described above.

Examples of the compounds represented by formula (I) are shown below. However, in the present invention, the compounds are not limited to these examples.

Compound 1

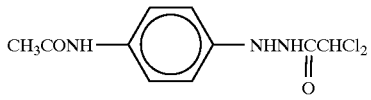

Compound 2

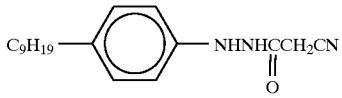

Compound 3

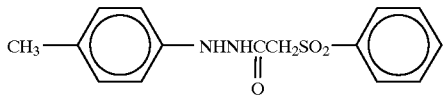

Compound 4

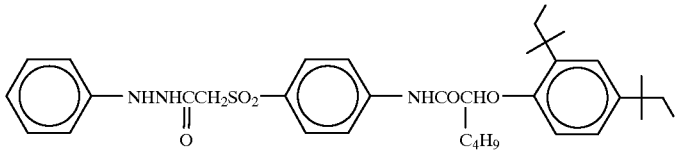

Compound 5

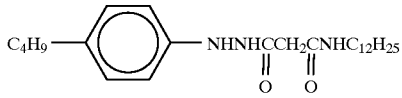

-continued
Compound 6
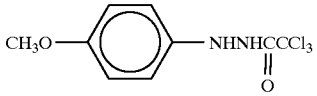
Compound 7
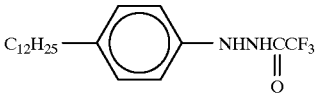
Compound 8
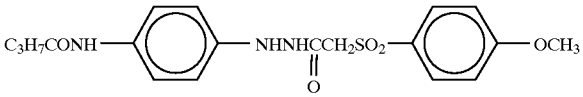
Compound 9
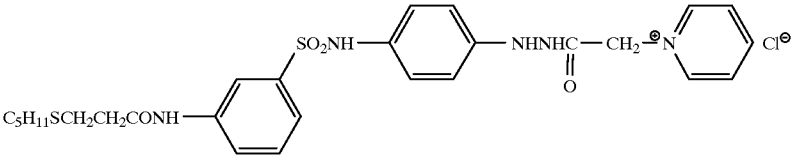
Compound 10
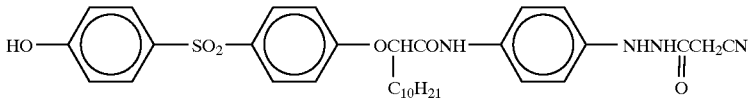
Compound 11
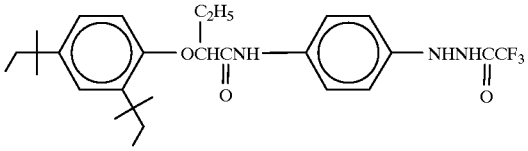
Compound 12
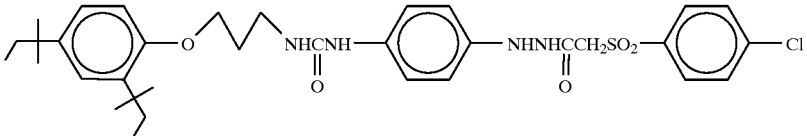
Compound 13
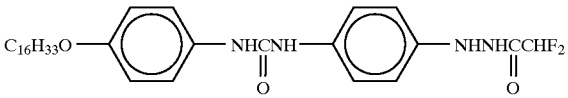
Compound 14
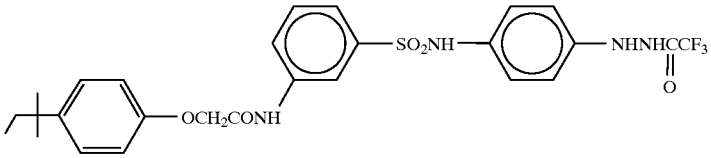
Compound 15
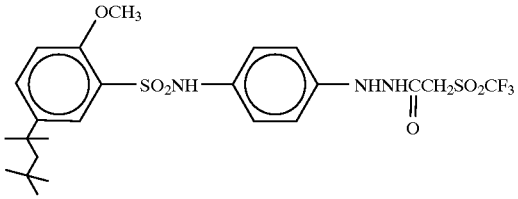

-continued
Compound 16
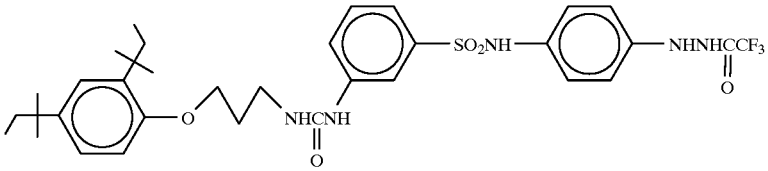
Compound 17
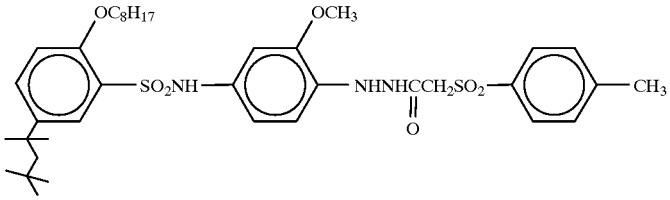
Compound 18
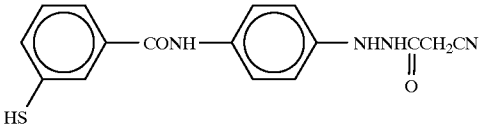
Compound 19
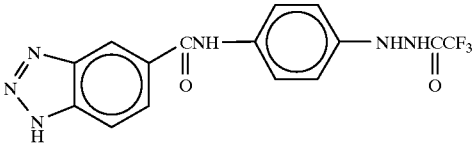
Compound 20
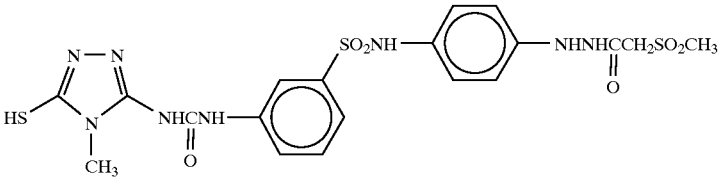
Compound 21
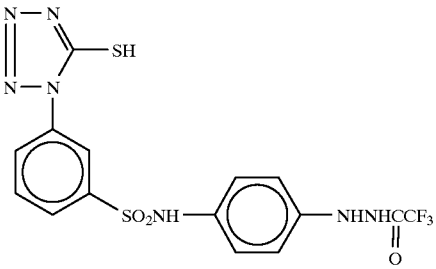
Compound 22
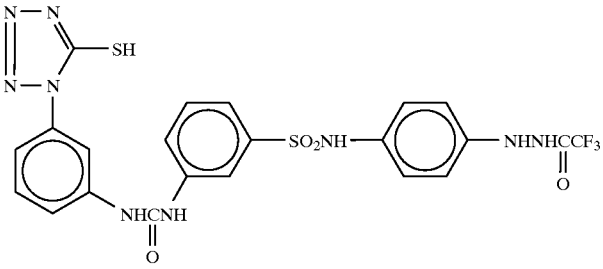

-continued
Compound 23
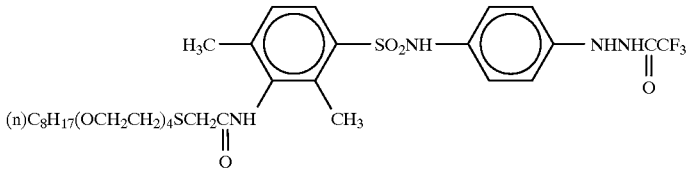
Compound 24
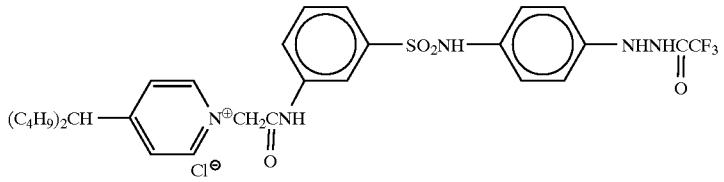
Compound 25
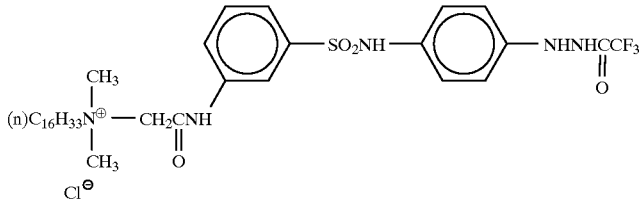
Compound 26
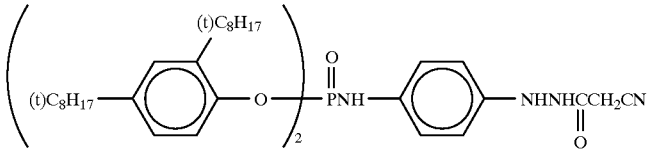
Compound 27
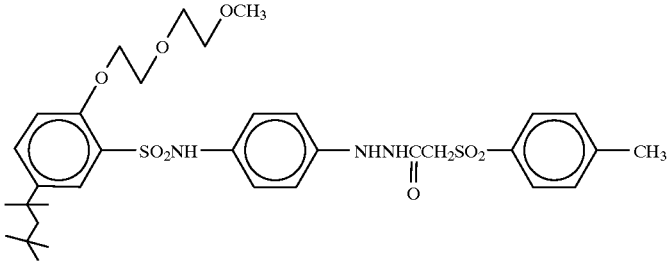
Compound 28
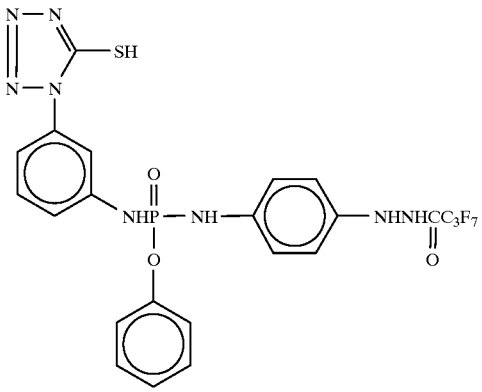

-continued
Compound 29
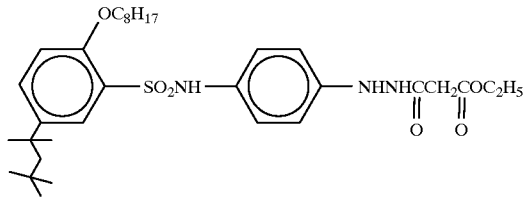
Compound 30
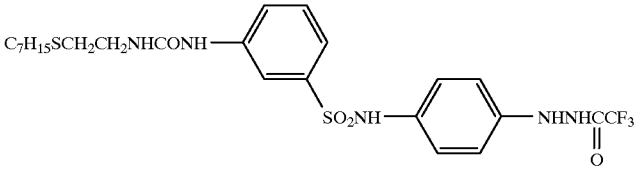
Compound 31
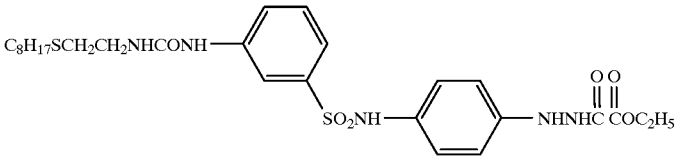
Compound 32
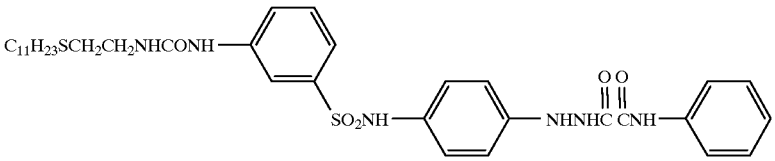
Compound 33
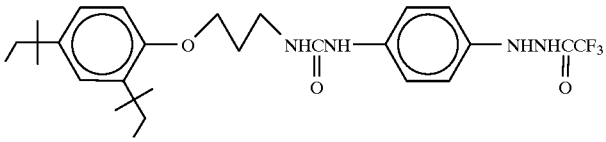
Compound 34
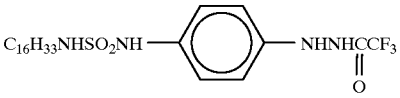
Compound 35
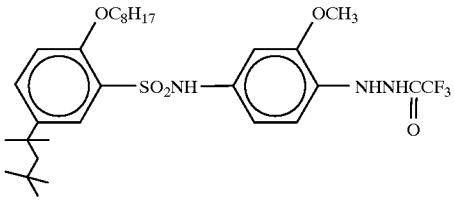
Compound 36
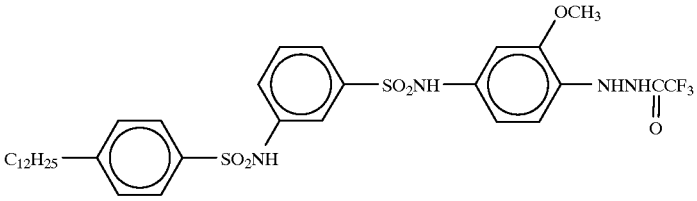

-continued
Compound 37
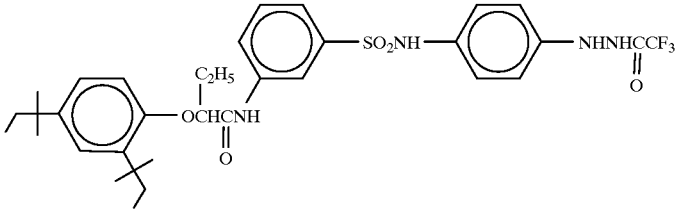
Compound 38
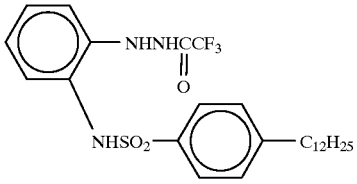
Compound 39
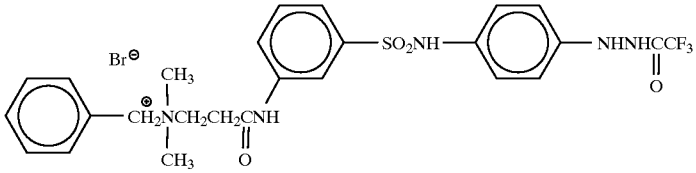
Compound 40
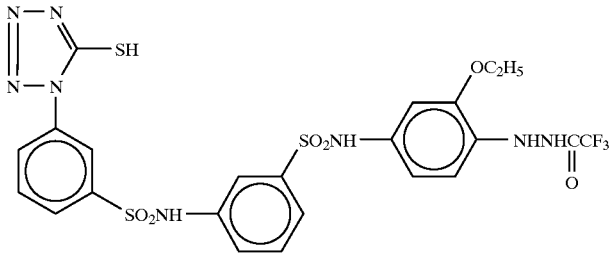
Compound 41
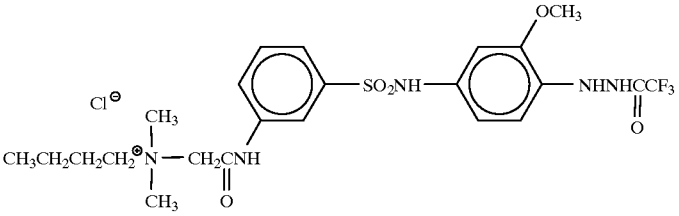
Compound 42
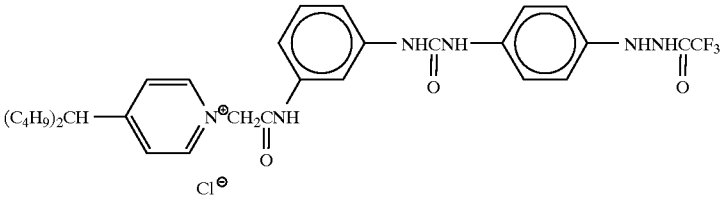
Compound 43
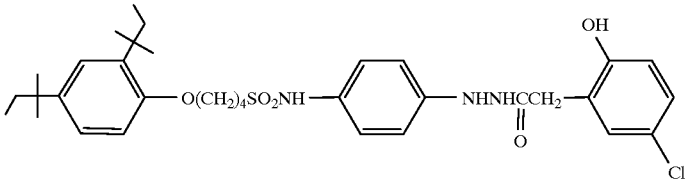

-continued

Compound 44

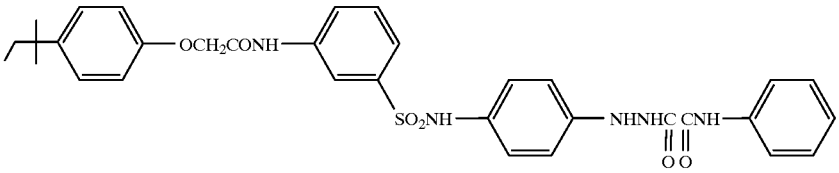

Examples of the hydrazine derivatives used in the present invention include, besides the above-mentioned derivatives, those which are described in *RESEARCH DISCLOSURE,* Item 23516 (November, 1983, p.346) and the literature cited therein, U.S. Pat. Nos. 4,080,207, 4,269,929, 4,276,364 4,278,748, 4,385,108, 4,459,347, 4,478,928, 4,560,638, 4,686,167, 4,912,016, 4,988,604, 4,994,365, 5,041,355, and 5,104,769, British Patent 2,011,391B, European Patents 217,310, 301,799 and 356,898, JP-A-60-179734, JP-A-61-170733, JP-A-61-270744, JP-A-62-178246, JP-A-62-270948, JP-A-63-29751, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843 JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544 JP-A-5-45761, JP-A-5-45762, JP-A-5-45763, JP-A-5-45764, JP-A-5-45765, and JP-A-6-289524.

The content of the hydrazine derivatives used in the present invention preferably is from $1\times10^{-6}$ to $5\times10^{-2}$ mol per mol of silver halide, and particularly preferably from $1\times10^{-5}$ to $2\times10^{-2}$ mol per mol of silver halide.

In order to use the hydrazine derivatives of the present invention, they are dissolved in a suitable organic water-miscible solvent which includes, for example, alcohols (methanol, ethanol, propanol, fluorinated alcohols), ketones (acetone, methyl ethyl ketone), dimethylformamide, dimethylsulfoxide, and methyl cellosolve. Further, according to a method well-known as emulsification dispersion, the hydrazine derivatives are dissolved in an oil such as dibutyl phthalate, tricresyl phosphate, glyceryl triacetate, and diethyl phthalate by use of a co-solvent such as ethyl acetate and cyclohexanone followed by preparing mechanically emulsified dispersions. Furthermore, according to a method known as solid dispersion, powdered hydrazine derivatives can be dispersed in water using a ball mill or a colloid mill, or through a ultrasonic wave.

In the photographic materials of the present invention, onium salts are preferably used as a nucleating accelerator.

The onium salts used preferably in the present invention are those which are represented by formulas (AI), (AII), (AIII), and (AIV):

(AI)

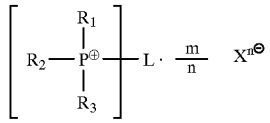

wherein $R_1$, $R_2$ and $R_3$ each represents an alkyl group, a cycloalkyl group, an aryl group, an alkenyl group, a cycloalkenyl group, and a heterocyclic group which may further have a substituent group; m represents an integer of 1 to 4; L represents an m-valent organic group, of which the carbon atom is linked to the phosphorus atom; n represents an integer of 1 to 3; and X represents an n-valent anion and may be linked to L.

(AII)

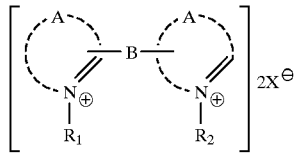

(AIII)

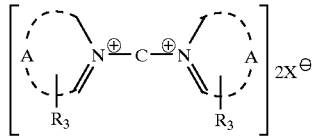

(AIV)

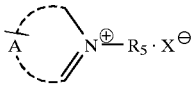

wherein A represents an organic residual group for completing a heterocycle; B and C each represents a divalent group; $R_1$ and $R_2$ each represents an alkyl group or an aryl group; $R_3$ and $R_4$ each represents a hydrogen atom or a substituent group; $R_5$ represents an alkyl group; X represents an anion, but when the compound is an inner salt, X is dispensable.

The formula (AI) is described in detail.

Examples of the groups represented by $R_1$, $R_2$ and $R_3$ include a straight-chain or branched-chain alkyl group such as a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group, and an octadecyl group; an aralkyl group such as a substituted or unsubstituted benzyl group; a cycloalkyl group such as a cyclopropyl group, a cyclopentyl group and a cyclohexyl group; an aryl group such as a phenyl group, a naphthyl group and a phenanthryl group; an alkenyl group such as an allyl group, a vinyl group and a 5-hexenyl group; a cycloalkenyl group such as a cyclopentenyl group and a cyclohexenyl group; a heterocyclic residual group such as a pyridyl group, a quinolyl group, a furyl group, an imidazolyl group, a thiazolyl group, a thiadiazolyl group, a benzotriazolyl group, a benzothiazolyl group, a morpholyl group, a pyrimidyl group, and pyrrolidyl group. The groups may have a substituent group. Examples of the substituent group include, besides the groups represented by $R_1$, $R_2$ and $R_3$, halogen atoms such as a fluorine atom, a chlorine atom, a bromine atom, and an iodine atom, a nitro group, primary, secondary, and tertiary amino groups, alkyl and aryl ether groups, alkyl and aryl thioether groups, a carbonamido group, a carbamoyl group, a sulfonamido group, a sulfamoyl group, a hydroxyl group, a sulfoxy group, a sulfonyl group, a carboxyl group, a sulfonic acid group, a cyano group, and a carbonyl group. Examples of the groups represented by L include, besides the same groups as represented by $R_1$, $R_2$ and $R_3$, polymethylene groups such as a trimethylene group, a tetramethylene group, a hexamethylene group, a pentamethylene group, an octamethylene group, and a dodecamethylene group; divalent aromatic groups such as a phenylene group, a biphenylene group, and a naphthylene group; polyvalent aliphatic groups such as a trimethylenemethyl group and a tetramethylenemethyl group; and polyvalent aromatic groups such as a phenylene-1,3,5-triyl group and a phenylene-1,2,4,5-tetrayl group.

Examples of the anions represented by X include halide ions such as a chloride ion, a bromide ion, and a iodide ion; carboxylate ions such as an acetate ion, an oxalate ion, a fumarate ion, and a benzoate ion; sulfonate ions such as a p-toluenesulfonate ion, a methanesulfonate ion, a butanesulfonate ion, and a benzenesulfonate ion; a sulfate ion; a perchlorate ion; a carbonate ion; and a nitrate ion.

In formula (AI), $R_1$, $R_2$ and $R_3$, each is preferably a group having 20 or less carbon atoms, and particularly preferably an aryl group having 15 or less carbon atoms. m is preferably 1 or 2. When m is 1, L is preferably a group having 20 or less carbon atoms, and particularly preferably an alkyl or aryl group of which a total number of carbon atoms is of 15 or less. When m is 2, examples of preferred divalent organic groups represented by L include an alkylene group, arylene group, divalent groups formed by linking these groups, or divalent groups formed by combining these groups with linkages —CO—, —O—, —$NR_4$— ($R_4$ represents a hydrogen atom or the groups having the same meaning as defined for $R_1$, $R_2$ and $R_3$; When a plurality of $R_4$ exists in a molecule, they may be the same or different or may be further linked to one another), —S—, —SO—, and —$SO_2$—. When m represents 2, L is particularly preferably a divalent group of which a total number of atoms is 20 or less, a carbon atom of the group being linked to the phosphorus atom. When m represents an integer of 2 or more, although a plurality of $R_1$, $R_2$ and $R_3$ exists, respectively, each of $R_1$, $R_2$ and $R_3$ may be the same or different.

n is preferably 1 or 2, and m is preferably 1 or 2. X may be linked to $R_1$, $R_2$, $R_3$, or L to form an inner salt.

Most of the compounds represented by formula (AI) are well-known and commercially available. As general methods of the preparation of these compounds, there are used the reaction of phosphinic acids with alkylating agents such as alkyl halides and sulfonic acid esters; and the exchange of counter anions in phosphonium salts according to an ordinary method.

Examples of the compounds represented by formula (AI) are shown below. However, in the present invention, the compounds are not limited to these examples.

A-101

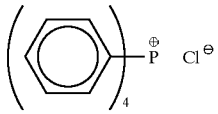

A-102

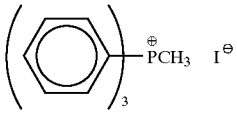

A-103

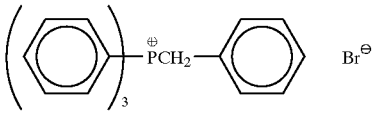

A-104

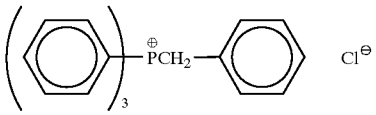

A-105

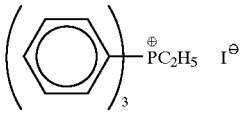

A-106

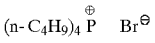

-continued
A-107
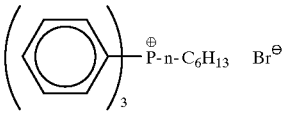
A-108
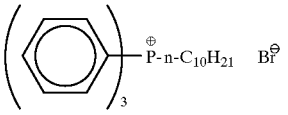
A-109
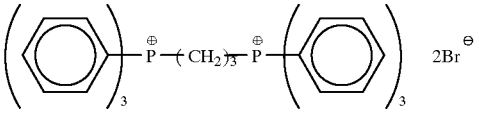
A-110
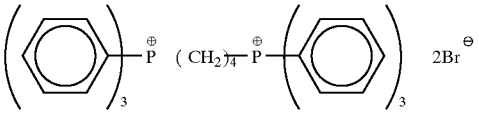
A-111
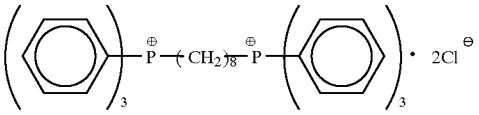
A-112
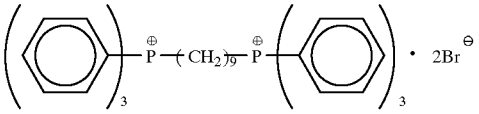
A-113
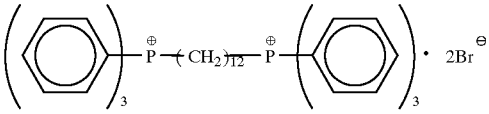
A-114
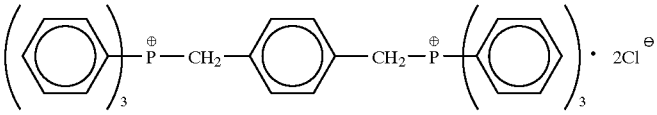
A-115
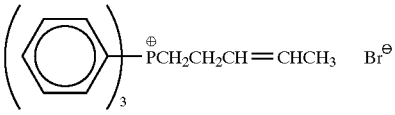
A-116
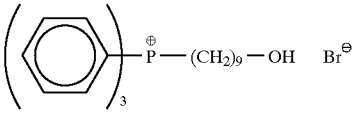
A-117
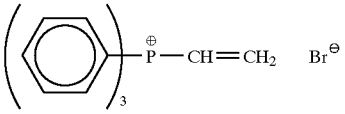
A-118
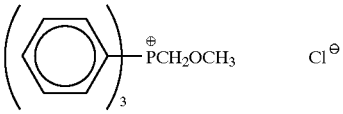

-continued
A-119
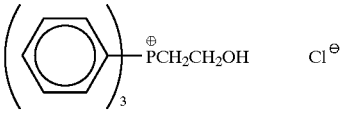
A-120
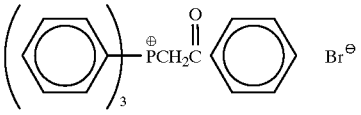
A-121
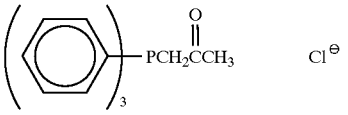
A-122
$(n\text{-}C_4H_9)_3\ \overset{\oplus}{P}CH_2CH_2OH\quad Br^{\ominus}$
A-123
$(n\text{-}C_4H_9)_3\ \overset{\oplus}{P}C_2H_5 \cdot \frac{1}{2} \cdot SO_4^{2\ominus}$
A-124
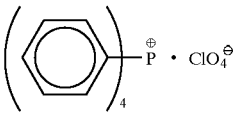
A-125
$Ph_3\overset{\oplus}{P}-(CH_2)_4COOH\quad Br^{\ominus}$
A-126
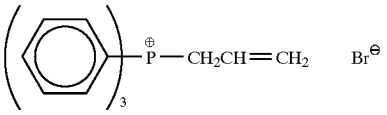
A-127
$(n\text{-}C_4H_9)_3\ \overset{\oplus}{P}\text{-}n\text{-}C_{16}H_{33}\quad Br^{\ominus}$
A-128
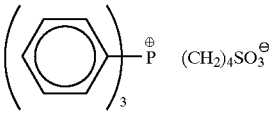
A-129
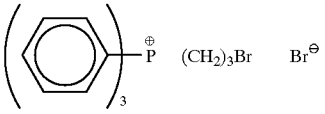
A-130
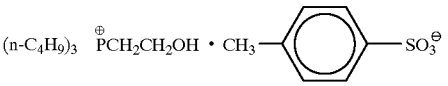
A-131
$(n\text{-}C_4H_9)_3\ \overset{\oplus}{P}CH_3I^{\ominus}$
A-132
$(HOCH_2)_3\ \overset{\oplus}{P}CH_3I^{\ominus}$ -continued
A-133
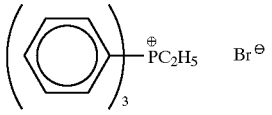
A-134
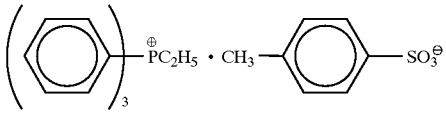
A-135
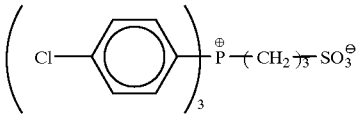
A-136
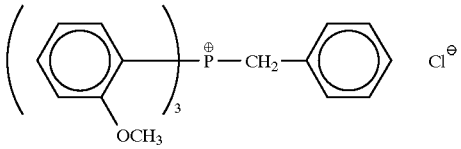
A-137
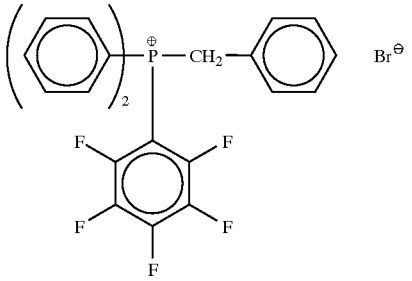
A-138
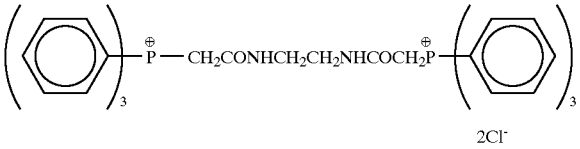
A-139
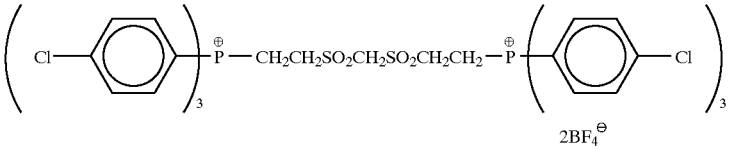
A-140
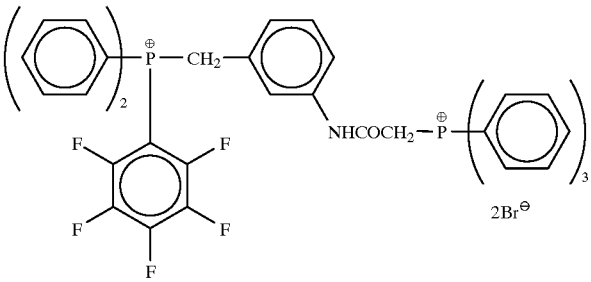
A-141
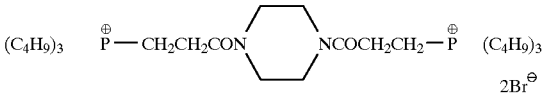

-continued

A-142

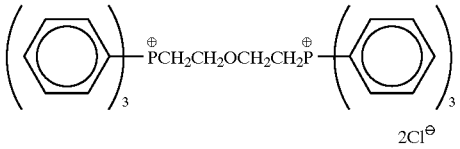

A-143

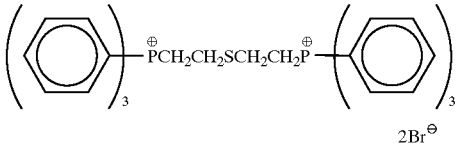

A-144

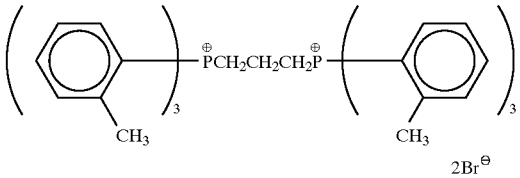

A-145

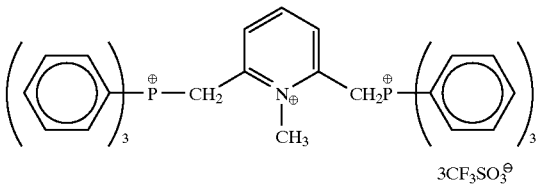

A-146

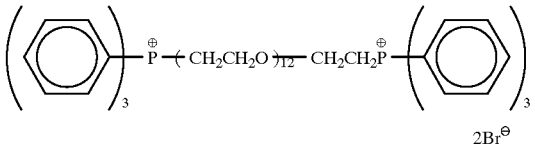

A-147

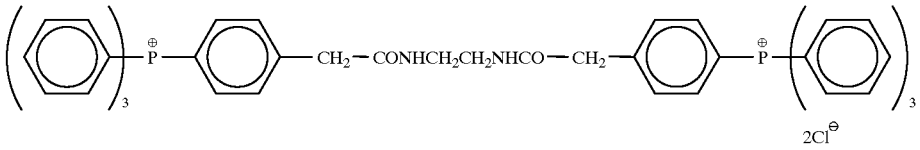

Subsequently, the formulas (AII), (AIII) and (AIV) are described in more detail below.

In the formulas, A represents an organic residual group for completing a heterocyclic ring which may contain a carbon atom, a hydrogen atom, an oxygen atom, a nitrogen atom, and a sulfur atom, and further may be fused together with a benzene ring. Preferred heterocyclic ring are 5- or 6-membered rings. Examples of more preferred rings include a pyridine ring, a quinoline ring, and an isoquinoline ring. A may have a substituent group. Examples of the substituent group include a halogen atom (for example, chlorine, bromine), a substituted or unsubstituted alkyl group (for example, methyl, hydroxylethyl), a substituted or unsubstituted aralkyl group (for example, benzyl, p-methoxyphenetyl), a substituted or unsubstituted aryl group (for example, phenyl, tolyl, p-chlorophenyl, furyl, thienyl, naphthyl), a substituted or unsubstituted acyl group (for example, benzoyl, p-bromobenzoyl, acetyl), a sulfo group, a carboxyl group, a hydroxyl group, an alkoxyl group (for example, methoxy, ethoxy), an aryloxy group, an amido group, a sulfamoyl group, a carbamoyl group, an ureido group, a unsubstituted or alkyl group-substituted amino group, a cyano group, a nitro group, an alkylthio group, and an arylthio group. Examples of particularly preferred substituent groups include an aryl group, a sulfo group, a carboxyl group, and a hydroxyl group.

The divalent groups represented by B and C preferably include alkylene, arylene, alkenylene, —$SO_2$—, —SO—, —O—, —S—, and —N($R_6$)—, which are used singly or in combination, with the proviso that $R_6$ represents an alkyl group, an aryl group, or a hydrogen atom. Particularly preferred examples of B and C include alkylene, arylene, —O—, and —S— which are used singly or in combination.

$R_1$ and $R_2$ are preferably an alkyl group having 1 to 20 carbon atoms and may be the same or different. The alkyl group may contain a substituent group. Examples of the substituent group include a halogen atom (for example, chlorine, bromine), a substituted or unsubstituted aryl group (for example, phenyl, tolyl, p-chlorophenyl, furyl, thienyl, naphthyl), a substituted or unsubstituted acyl group (for example, benzoyl, p-bromobenzoyl, acetyl), a sulfo group, a carboxyl group, a hydroxyl group, an alkoxyl group (for example, methoxy, ethoxy), an aryloxy group, an amido group, a sulfamoyl group, a carbamoyl group, a ureido group, an unsubstituted or alkyl group-substituted amino group, a cyano group, a nitro group, an alkylthio group, and an arylthio group. $R_1$ and $R_2$ each particularly preferably represents an alkyl group having 1 to 10 carbon atoms. Preferred substituent groups of $R_1$ and $R_2$ are an aryl group, a sulfo group, a carboxyl group, and a hydroxyl group.

$R_3$ and $R_4$ each represents a hydrogen atom or a substituent group. The substituent group can be selected among the substituent groups which are described above for the alkyl group represented by $R_1$ and $R_2$. $R_3$ and $R_4$ each preferably has 0 to 10 carbon atoms, and examples thereof include an aryl group-substituted alkyl group and a substituted or unsubstituted aryl group.

$R_5$ preferably represents an alkyl group having 1 to 20 carbon atoms, which may be a straight-chain, branched-chain, or cyclic alkyl group. The alkyl group may contain a substituent group, which may be selected among the substituent groups which are described above for the alkyl group represented by $R_1$ and $R_2$.

X represents an anion, with the proviso that X is dispensable, when the compound is an inner salt. Examples of X include a chloride ion, a bromide ion, an iodide ion, a nitrate ion, an sulfate ion, a p-toluenesulfonate ion, and an oxalate ion.

The compounds represented by formulas (AII), (AIII), and (AIV) can be easily prepared according to well-known methods. The following literature is instructive; Quart. Rev., 16, 163 (1962).

Examples of the compounds represented by formulas (AII), (AIII) and (AIV) are shown below. However, in the present invention, the compounds are not limited to these examples.

A-201

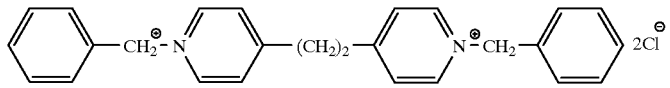

A-202

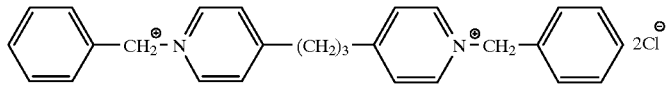

A-203

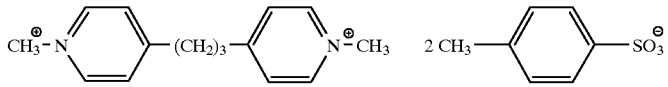

A-204

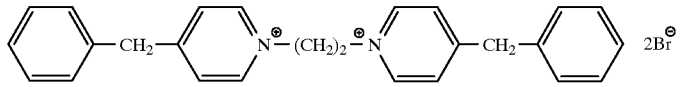

A-205

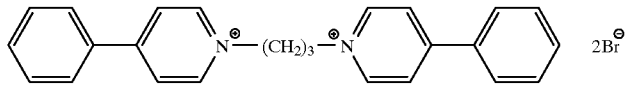

A-206

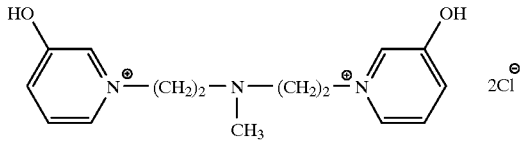

A-207

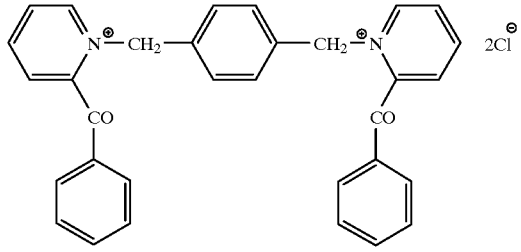

A-208

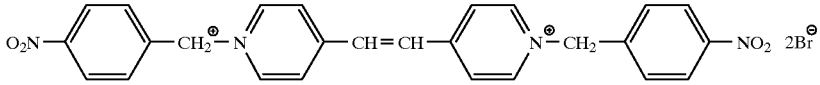

-continued
A-209
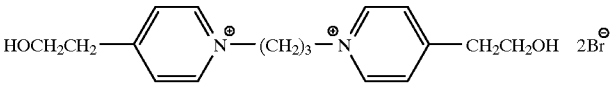
A-210
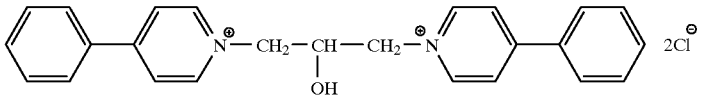
A-211
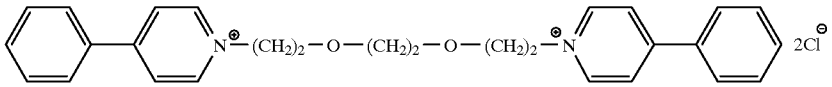
A-212
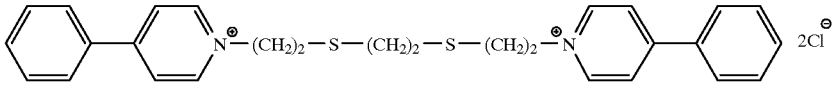
A-213
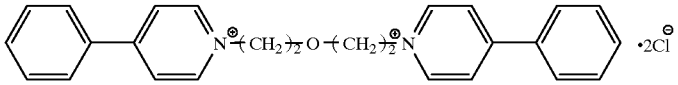
A-214
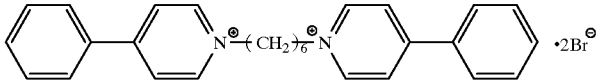
A-215
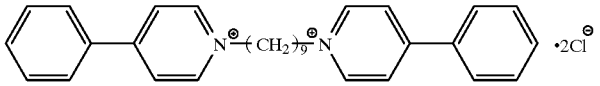
A-216
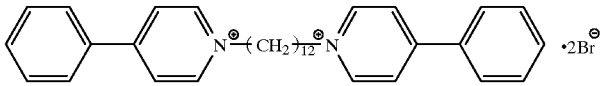
A-217
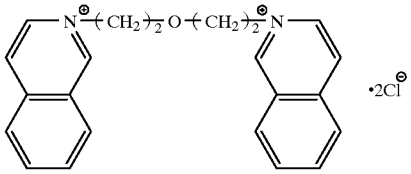
A-218
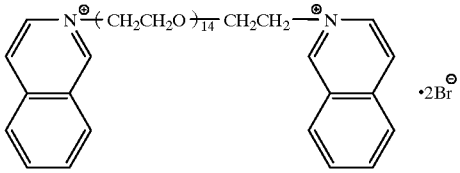
A-219
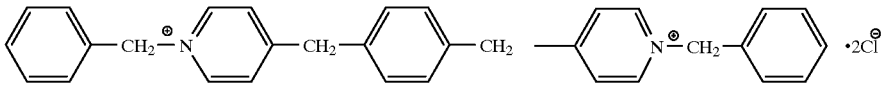
A-220
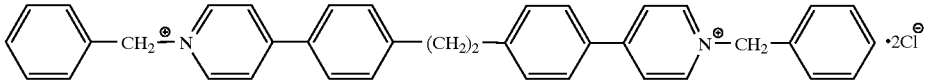
A-221
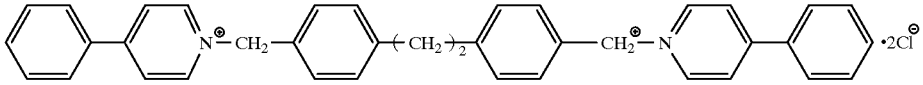

-continued
A-222
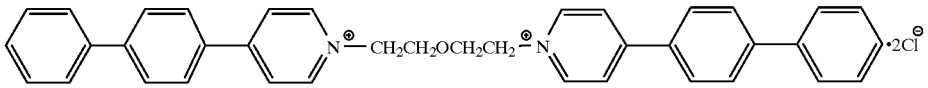
A-223
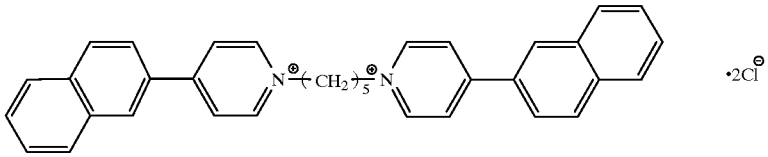
A-224
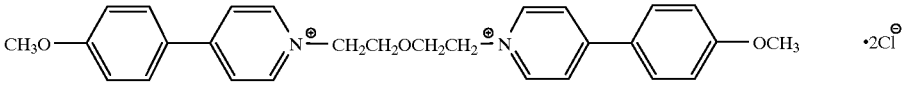
A-225
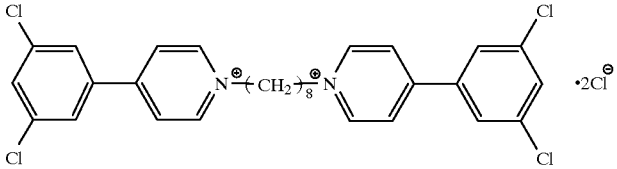
A-226
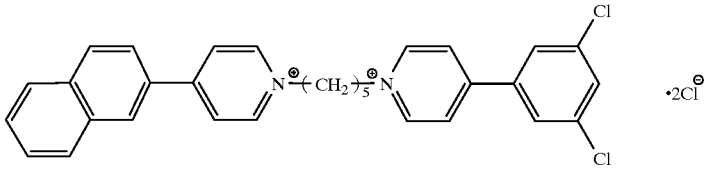
A-227
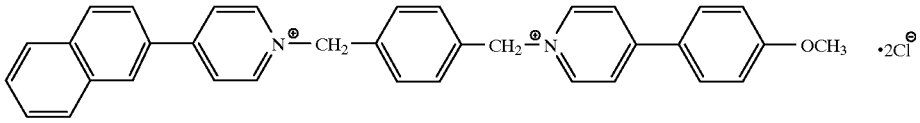
A-228
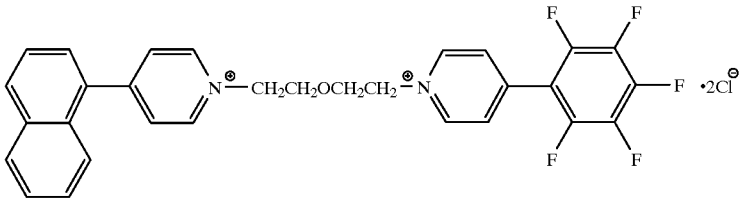
A-229
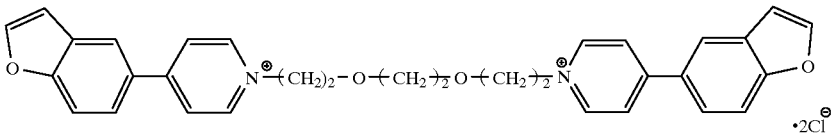
A-230
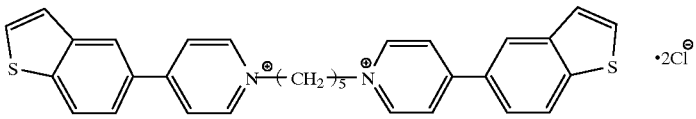
A-231
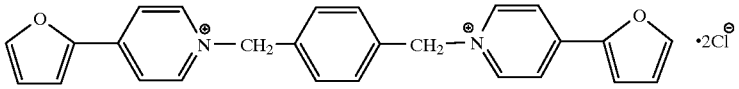

-continued
A-232
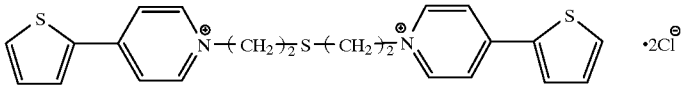
A-233
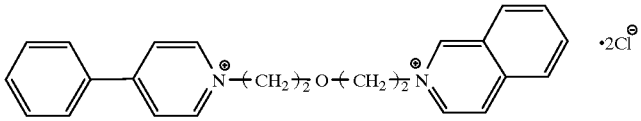
A-234
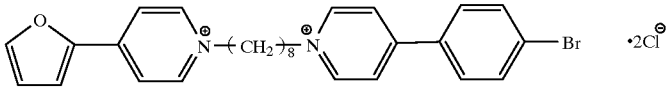
A-235
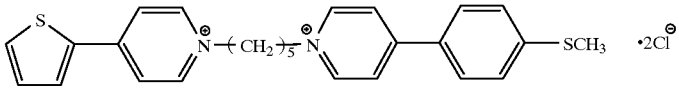
A-236
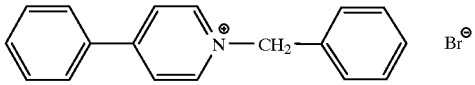
A-237
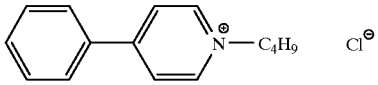
A-238
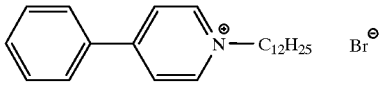
A-239
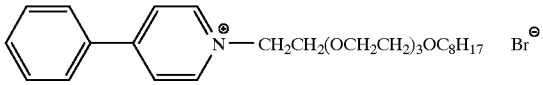
A-240
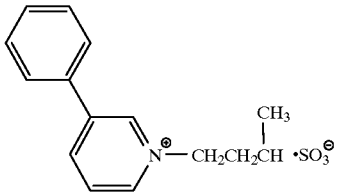
A-241
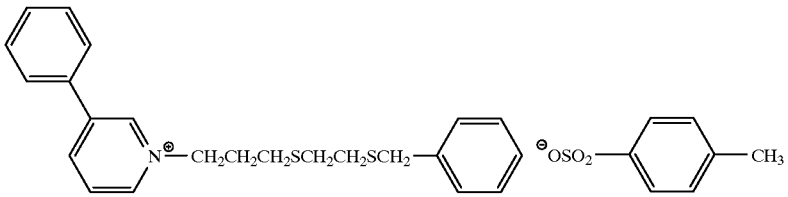
A-242
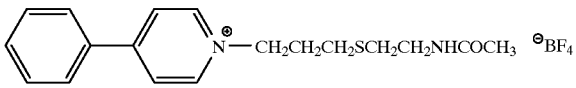
A-243
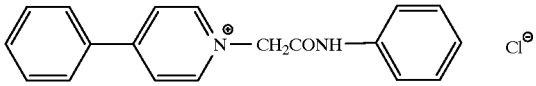

-continued
A-244
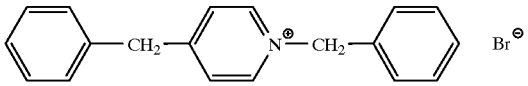
A-245
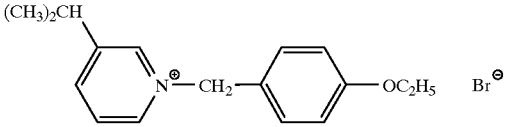
A-246
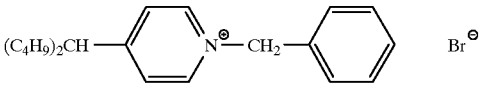
A-247
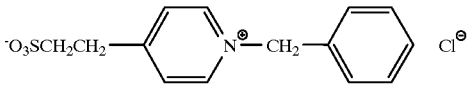
A-248
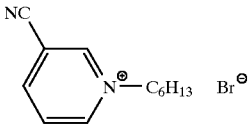
A-249
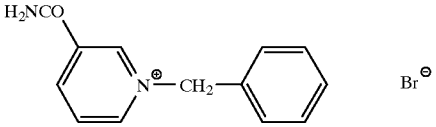
A-250
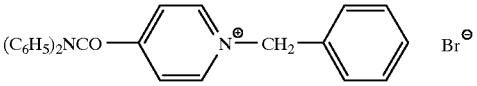
A-251
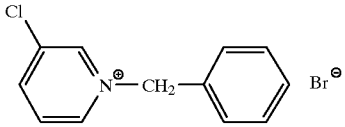
A-252
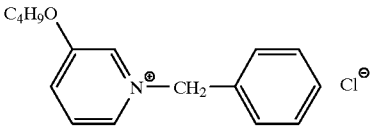
A-253
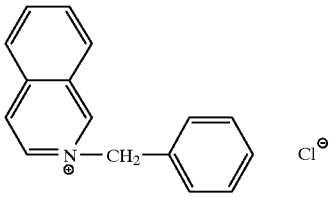
A-254
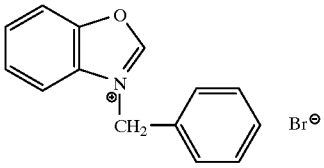

-continued

A-255

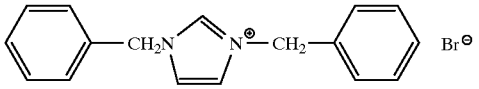

Although the content of the compounds represented by formulas (AI), (AII), (AIII), and (AIV) is not particularly limited, it is preferably from $1\times10^{-5}$ to $2\times10^{-2}$ mol per mol of silver halide, and particularly preferably from $2\times10^{-5}$ to $1\times10^{-2}$ mol per mol of silver halide.

To add the compounds of formulas (AI) to (AIV) of the present invention to the photographic materials, when the compounds are water-soluble, they can be added as aqueous solutions to the silver halide emulsions or to hydrophilic colloid solutions and, on the contrary, when the compounds are water-insoluble, they can be added thereto as solutions in water-miscible organic solvents such as alcohols (for example, methanol, ethanol), esters (for example, ethyl acetate), and ketones (for example, acetone). Further, according to a method well-known as emulsification dispersion, the compounds are dissolved in oils such as dibutyl phthalate, tricresyl phosphate, glycelyl triacetate, or diethyl phthalate by use of auxiliary solvents (i.e., co-solvents) such as ethyl acetate and cyclohexanone followed by mechanically preparing emulsified dispersions. Furthermore, the compounds also can be used as dispersions of fine powder thereof which are prepared according to a method known as solid dispersion.

Developers used in the present invention are those having a pH of 9.0 to 11.0, and are prepared by combining ascorbic acids as developing agents with superadditive developing agents. Combinations of ascorbic acids with 1-phenyl-3-pyrazolidones or combinations of ascorbic acids with p-aminophenols are preferably used. Dihydroxybenzene as a developing agent is not substantially added to the developers.

The ascorbic acids used in the present invention mean ascorbic acid and its salts and erythorbic acid and its salts.

Examples of the 1-phenyl-3-pyrazolidone and its derivatives used as the auxiliary developing agents in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophyenyl-4,4-dimethyl-3-pyrazolidone, 1-p-tolyl-4,4-dimethyl-3-pyrazolidone, and 1-p-tolyl-4-methyl-4-hydroxymethtyl-3-pyrazolidone.

Examples of the p-aminophenol type auxiliary developing agents used in the present invention include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, and so forth. Among these, N-methyl-p-aminophenol is preferably used.

In general, the content of these developing agents in the developer preferably ranges from 0.05 to 0.8 mol/liter. In combinations of ascorbic acids with 1-phenyl-3-pyrazolidones or p-aminophenols, the content of the former preferably ranges from 0.05 to 0.5 mol/liter, and that of the latter ranges preferably 0.06 mol/liter or less.

Examples of sulfite preservatives used in the present invention include sodium sulfite, potassium sulfite, lithium sulfite, ammonium sulfite, sodium bisulfite, potassium metabisulfite, and formaldehyde sodium bisulfite. The content of these sulfites ranges from 0.01 to 1.0 mol/liter, and preferably from 0.05 to 0.5 mol/liter.

In a method for forming a super-high contrast image using customary hydrazine derivatives, developers have necessitated high concentrations of sulfite of 0.3 mol/liter or more. Hence, the developers have the disadvantage of increasing silver stain due to increase in concentration of silver ion in the developers, as the amount of development treatment increases. On the other hand, the developers of the present invention do not have such drawback, because of low concentrations of the sulfites as described above.

Examples of pH adjusters or buffering agents used as alkaline agents for adjusting pH of the developers include sodium hydroxide, potassium hydroxide, sodium carbonate, potassium carbonate, sodium tertiary phosphate, potassium tertiary phosphate, sodium silicate, and potassium silicate.

As other additives than the above-mentioned components, there are used compounds such as boric acid and borax; development inhibitors such as sodium bromide, potassium bromide and potassium iodide; organic solvents such as ethylene glycol, diethylene glycol, triethylene glycol, dimethylformamide, methyl cellosolve, hexylene glycol, ethanol, and methanol; antifoggants (e.g., a mercapto type compound such as 1-phenyl-5-mercaptotetrazole and sodium 2-mercaptobenz-imidazole-5-sulfonate, an indazole type compound such as 5-nitroindazole, and a benztriazole type compound such as 5-methylbenztriazole); and further, if desired, toning agents, surfactants, antifoaming agents, hard-water softeners, and hardeners. Particularly, additives used preferably for the promotion of development or increase in sensitivity are amino compounds described in JP-A-56-106244 or imidazole compounds described in JP-B-48-35493 (The term "JP-B" as used herein means an "examined Japanese patent publication").

The developers used in the present invention may contain compounds described in JP-A-56-24347 and JP-A-4-362942 as silver stain inhibitors, compounds described in JP-A-62-212651 as uneven development inhibitors, and compounds described in JP-A-61-267759 as dissolution aids.

Examples of buffering agents for the developers used in the present invention include boric acid described in JP-A-62-186259, sugars (for example, saccharose) described in JP-A-60-93433, oximes (for example, acetoxime), phenols (for example, 5-sulfosalicylic acid), and tertiary phosphates (for example, sodium salt and potassium salt). Among these, boric acid is preferably used.

The fixer used in the present invention is an aqueous solution containing, besides a fixing agent, a hardening agent (for example, water-soluble aluminum compounds), acetic acid and a dibasic acid (for example, tartaric acid, citric acid, or their salts), and is preferably adjusted to pH 3.8 or more, and more preferably to pH 4.0 to 5.5.

The fixing agents used are sodium thiosulfate, ammonium thiosulfate, and so forth. In view of fixing speed, ammonium thiosulfate is particularly preferred. Although the content of the fixing agents can be suitably changed, it is from about 0.1 to about 5 mol/liter in general.

The water-soluble aluminum salts mainly acting as a hardener in the fixer are compounds known as a hardener for an acidic hardening fixer, and examples of the salts include aluminum chloride, aluminum sulfate and potash alum.

The above-mentioned dibasic acid includes tartaric acid and its derivatives, and citric acid and its derivatives, which can be used singly or as a mixture of two or more kinds thereof. The content of these compounds is effectively 0.005 mol or more per liter of the fixer, and particularly effectively from 0.01 to 0.03 mol/liter.

Examples of tartaric acid and its derivatives include tartaric acid, potassium tartarate, sodium tartarate, sodium potassium tartarate, ammonium tartarate, and potassium ammonium tartarate. Examples of effective citric acid and its derivatives include citric acid, sodium citrate, potassium citrate, and so forth.

The fixers may contain, if desired, preservatives (for example, sulfites, bisulfites), pH buffering agents (for example, acetic acid, boric acid), pH adjustors (for example, ammonia, sulfuric acid), image storage improvers (for example, potassium iodide), and chelating agents. The content of the pH buffering agents in the fixer is from 10 to 40 g/liter, and preferably from 18 to 25 g/liter, because of high pH of the developer.

The temperature and time of fixation are similar to those of development. That is, the temperature is from about 20° to about 50° C., and the time is from 10 sec to 1 min.

Washing water may contain antifungal agents [for example, compounds described in Horiguchi, Bohkin Bohbai no Kagaku (Chemistry of Bacteria Prevention and Fungus Prevention) and in JP-A-62-115154], washing accelerators (for example, sulfites), and chelating agents.

The photographic materials developed and fixed according to the above-mentioned methods are subsequently subjected to washing and drying. Washing is carried out at an temperature of about 20° to about 50° C. for 10 sec to 3 min to almost completely remove silver salt dissolved through fixation. Drying is carried out at a temperature of about 40° to about 100° C. Although the drying time depends on surrounding conditions, it is usually from about 5 sec to 3 min and 3 sec.

A roller transport type automatic developing machine has been described in U.S. Pat. Nos. 3,025,779 and 3,545,971. In the present specification, it is simply referred to as a "a roller transport type processor". In the roller transport type processor, the processing operation consists of 4 steps, namely, developing, fixing, washing and drying steps. Although the process of the present invention does not necessarily exclude the other steps (for example, a stopping step), it is most preferred to follow this customary four-step system. In this system, the washing step can save water by use of 2- or 3-stage countercurrent washing system. It takes 30 sec to 2 min for the total processing.

The developer used in the present invention is preferably stored in a casing having low oxygen permeability described in JP-A-61-73147. Further, a replenishment system of the developer described in JP-A-62-91939 can be preferably utilized for the developer used in the present invention.

Various types of additives and methods for developing used for the photographic materials of the present invention are not particularly limited. For example, the additives and methods can be preferably employed as shown below.

| Item | Corresponding Portion |
|---|---|
| 1) Nucleating Accelerators | JP-A-2-103536, page 9, upper right column, line 13 to page 16, upper left column, line 10, formulas (II-m) to (II-p) and compounds II-1 to II-22; compounds described in JP-A-1-179939 |

-continued

| Item | Corresponding Portion |
|---|---|
| 2) Silver Halide Emulsions and Methods for Preparation Thereof | JP-A-2-97937, page 20, lower right column, line 12 to page 21, lower left column, line 14; JP-A-2-12236, page 7, upper right column, line 19 to page 8, lower left column, line 12 and method of selenium sensitization described in JP-A-5-11389 |
| 3) Spectral Sensitizing Dyes | JP-A-2-12236, page 8, lower left column, line 13 to lower right column, line 4; JP-A-2-103536, page 16, lower right column, line 3 to page 17, lower left column, line 20; and spectral sensitizing dyes described in JP-A-1-112235, JP-A-2-124560, JP-A-3-7928, JP-A-5-11389 |
| 4) Surfactants | JP-A-2-12236, page 9, upper right column, line 7 to lower right column, line 7; JP-A-2-18542, page 2, lower left column, line 13 to page 4, lower right column, line 18; and JP-A-7-56267 |
| 5) Antifoggants | JP-A-2-103536, page 17, lower right column, line 19 to page 18, upper right column, line 4; lower right column, line 1 to line 5; and thiosulfinic acid compounds described in JP-A-1-237538 |
| 6) Polymer Latex | JP-A-2-103536, page 18, lower left column, line 12 to line 20 |
| 7) Compounds Containing Acid Group | JP-A-2-103536, page 18, lower right column, line 6 to page 19, upper left column, line 1 |
| 8) Matting agents, Lubricants and Plasticizers | JP-A-2-103536, page 19, upper left column, line 15 to page 19, upper right column, line 15 |
| 9) Hardeners | JP-A-2-103536, page 18, upper right column, line 5 to line 17 |
| 10) Dyes | dyes described in JP-A-2-103536, page 17, lower right column, line 1 to line 18; and solid dyes described in JP-A-2-294638 and JP-A-5-11382 |
| 11) Binders | JP-A-2-18542, page 3, lower right column, line 1 to line 20 |
| 12) Black Pepper Inhibitors | compounds described in U.S. Pat. No. 4,956,257 and JP-A-1-118832 |
| 13) Monomethine Compounds | compounds represented by formula (II) described in JP-A-2-287532 (particularly compounds II-1 to II-26) |
| 14) Dihydroxybenzenes | JP-A-3-39948, page 11, upper left column to page 12, lower left column; compounds described in European Patent 452,722A |
| 15) Developers and Methods for Developing | JP-A-2-103536, page 19, upper right column, line 16 to page 21, upper left column, line 8 |

The present invention is illustrated below with reference to examples. However, the present invention is not limited by these examples.

EXAMPLE 1

Preparation of Silver Halide Photographic Materials

Preparation of Emulsion:

Emulsions A and B are prepared as follows:

[Emulsion A]

An aqueous solution of silver nitrate and an aqueous solution of halides containing potassium bromide, sodium chloride, $K_3IrCl_6$ in an amount corresponding to $3.5\times10^{-7}$ mol per mol of silver, and $K_2Rh(H_2O)Cl_5$ in an amount corresponding to $2.0\times10^{-7}$ mol per mol of silver were added with stirring to an aqueous gelatin solution containing sodium chloride and 1,3-dimethyl-2-imidazolidinethion by a double jet method to prepare silver chlorobromide grains containing 70 mol % of silver chloride which had an average grain size of 0.25 μm.

The grains was then washed with water according to an ordinary method of flocculation. Subsequently, 40 g per mol of silver of gelatin, and further, 7 mg per mol of silver of sodium benzenethiosulfonate and 2 mg per mol of silver of benzenesulfinic acid were added. The resulting emulsion was adjusted to pH 6.0 and pAg 7.5. 2 mg per mol of silver of sodium thiosulfate and 4 mg per mol of silver of chloroauric acid were further added to be subjected to chemical sensitization so as to obtain an optimum sensitivity at 60° C. Thereafter, 150 mg of 4-hydroxy-6-methyl-1,3,3a,7-tetrazaindene was added as a stabilizer, and further, 100 mg of proxel as a preservative. The thus-obtained grains had an average size of 0.25 μm, which were silver chlorobromide cubic grains having a silver chloride content of 70 mol % (coefficient of variation: 10%).

Preparation of Coating Samples

On a polyethylene terephthalate film support which has a moisture-barrier undercoating layer containing vinylidene chloride formed on the support, a UL layer, an EM layer, a PC layer, and an OC layer were provided in this order from the support side to form a multilayer structure, thus preparing samples.

Methods for preparing these layers and the coating amounts thereof are shown below.

(UL layer)

A dispersion containing 30% by weight, based on gelatin of polyethyl acrylate, was added to an aqueous solution of gelatin. This was applied so that the coating amount of gelatin could be 0.5 g/m$^2$.

(EM Layer)

To the above-mentioned emulsion A, the following Compound (S-1) in an amount of $5\times10^{-4}$ mol per mol of silver and Compound (S-2) in an amount of $5\times10^{-4}$ mol per mol of silver as sensitizing dyes were added, and further, a mercapto compound represented by the following (a) in a amount of 3×10−4 mol per mol of silver, a mercapto compound represented by (b) in an amount of $4\times10^{-4}$ mol, a triazine compound represented by (c) in an amount of $4\times10^{-4}$ mol, 5-chloro-8-hydroxy-quinoline in an amount of $2\times10^{-3}$ mol, the following surface active compound (W-1) in an amount of $5\times10^{-4}$ mol, and the following nucleating agent (A-1) in an amount of $4\times10^{-4}$ mol were added to the emulsion. Further, hydroquinone and N-oleyl-N-methyltaurine sodium salt were added in coating amounts of 100 mg and 30 mg/m$^2$, respectively. Subsequently, a hydrazine derivative (Compound 14) in an amount of $5\times10^{-4}$ mol, a water-soluble latex represented by (d) in an amount of 200 mg/m$^2$, a dispersion of polyethyl acrylate in an amount of 200 mg/m$^2$, a copolymer latex prepared from methyl acrylate, sodium 2-acrylamido-2-methylpropanesulfonate, and 2-acetoacetoxyethyl methacrylate (weight ratio 88:5:7) in an amount of 200 mg/m$^2$, colloidal silica with an average particle size of 0.02 μm in an amount of 200 mg/m$^2$, and 1,3-divinylsulfonyl-2-propanol as a hardener in an amount of 200 mg/m$^2$ were added. The resulting solution was adjusted to pH 5.65 by use of acetic acid. This solution was applied so that the coating amount of silver is 3.5 g/m$^2$.

(PC Layer)

To an aqueous solution of gelatin, there were added a dispersion containing 50% by weight of ethyl acrylate based on gelatin, one of compounds represented by formula (A) of the present invention or one of comparative compounds shown in Table 1 each in an amount of $1\times10^{-2}$ mol per mol of silver contained in the EM layer, and 1,5-dihydroxy-2-benzaldoxime so that the coating amount is 10 mg/m$^2$, and the resulting solutions were applied so that the coating amount of gelatin is 0.5 g/m$^2$.

(OC Layer)

There were applied gelatin in an amount of 0.5 g/m$^2$, amorphous $SiO_2$ as a matting agent with an average particle size of about 3.5 μm in an amount of 40 mg/m$^2$, methanol silica in an amount of 0.1 g/m$^2$, polyacrylamide in an amount of 100 mg/m$^2$, a silicone oil in an amount of 20 mg/m$^2$, and as coating additives, a fluorine-based surfactant represented by the following formula (e) in an amount of 5 mg/m$^2$ and sodium dodecylbenzenesulfonate in an amount of 100 mg/m$^2$.

Comparative Compound-1

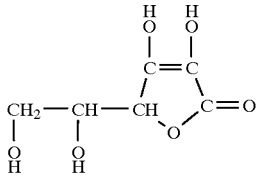

Comparative Compound-2

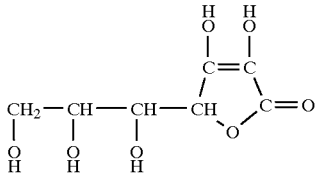

(S-1)

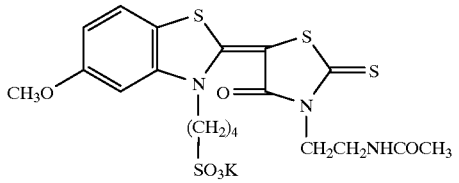

(S-2)

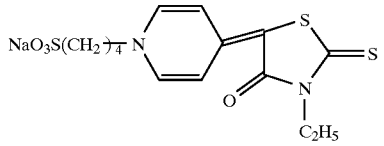

(a)

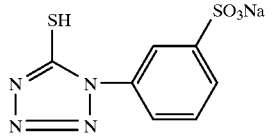

(b)

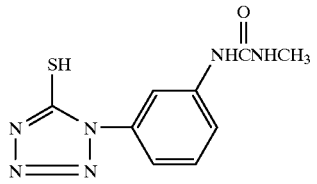

-continued (c)

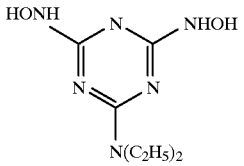

(A-1)

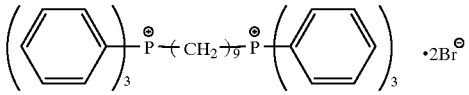

(W-1)

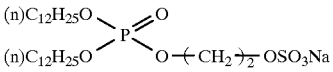

(d)

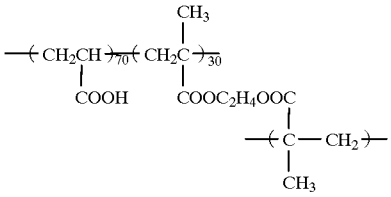

(e)

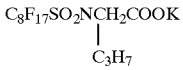

TABLE 1

| Sample No. | Compounds Added To PC Layer |
|---|---|
| 1-1 | — |
| 1-2 | Comparative Compound-1 |
| 1-3 | Comparative Compound-2 |
| 1-4 | Compound A-3 of the Present Invention |
| 1-5 | Compound A-5 of the Present Invention |
| 1-6 | Compound A-8 of the Present Invention |
| 1-7 | Compound A-9 of the Present Invention |

These coating samples each has a backing layer and a protective backing layer formed according to the respective formulations as shown below.

[Formulation of Backing Layer]

| | |
|---|---|
| Gelatin | 3 g/m$^2$ |
| Polyethyl Acrylate Latex | 2 g/m$^2$ |
| Sodium p-Dodecylbenzenesulfonate (Surfactant) | 40 mg/m$^2$ |
| 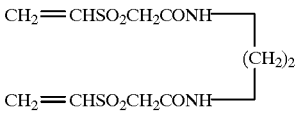 | 110 mg/m$^2$ |
| $SnO_2$/Sb (Weight Ratio 90/10, Average Particle Size: 0.20 μm) | 200 mg/m$^2$ |

Dyes Mixture of Dyes [a], [b] and [c]

| | |
|---|---|
| Dye [a] | 70 mg/m$^2$ |
| Dye [b] | 70 mg/m$^2$ |
| Dye [c] | 90 mg/m$^2$ |
| Dye [a] | |

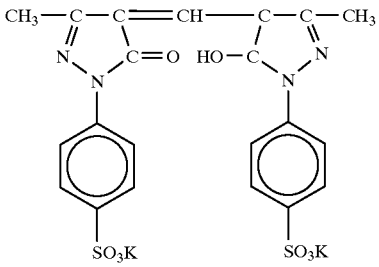

Dye [b]

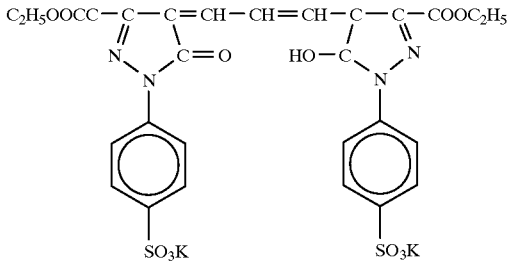

Dye [c]

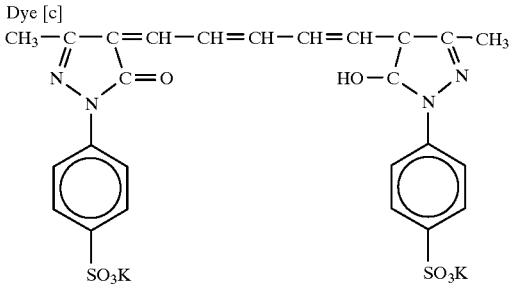

Protective Backing Layer

| | |
|---|---|
| Gelatin | 0.8 mg/m$^2$ |
| Finely Powdered Polymethyl Methacrylate (Average Particle Size: 4.5 μm) | 30 mg/m$^2$ |
| Sodium Dihexyl-α-sulfosuccinate | 15 mg/m$^2$ |
| Sodium p-Dodecyibenezenesulfonate | 15 mg/m$^2$ |
| Sodium Acetate | 40 mg/m$^2$ |

Evaluation of Photographic Performance (1) Exposure and Development:

The above-mentioned samples were exposed to a xenon flash light having an emission time of $10^{-5}$ sec through an interference filter having a peak at 488 nm, developed at 35° C. for 30 sec with developers A to D having formulations shown in Table 2, fixed, washed, and then dried.

TABLE 2

| | Developer A Present Invention (g) | Developer B Present Invention (g) | Developer C Comparative Example (g) | Developer D Comparative Example (g) |
|---|---|---|---|---|
| Potassium Hydroxide | 25.0 | 25.0 | 25.0 | 25.0 |
| Diethylenetriamine-pentaacetic Acid | 2.0 | 2.0 | 2.0 | 2.0 |
| Potassium Carbonate | 42.0 | 42.0 | 42.0 | 42.0 |
| Sodium Metabisulfite | 20.0 | 20.0 | 20.0 | 20.0 |
| Potassiuin Bromide | 1.0 | 1.0 | 1.0 | 1.0 |
| Hydroquinone | — | — | 25.0 | 25.0 |
| 5-Methylbenzotriazole | 1.0 | 1.0 | 1.0 | 1.0 |
| N-Methyl-p-aminophenol | 4.5 | — | 1.5 | 1.5 |
| Boric Acid | 12.0 | 12.0 | 12.0 | 12.0 |
| Sodium Erysorbate | 30.0 | 30.0 | — | — |
| 4-Hydroxymethyl-4-methyl-1-phenyl-3-pyrazolidone | — | 1.5 | — | — |
| Water to make 1 liter (adjusted to pH 9.8) | | | | |

The fixer is prepared according to the following formulation.

| (Formulation of Fixer) | |
|---|---|
| Ammonium Thiosulfate | 359.1 ml |
| Disodium Ethylenediaminetetraacetate Dihydrate | 2.26 g |
| Sodium Thiosulfate Pentahydrate | 32.8 g |
| Sodium Thiosulfite | 64.8 g |
| Sodium Hydroxide | 37.2 g |
| Glacial Acetic Acid | 87.3 g |
| Tartaric Acid | 8.76 g |
| Sodium Gluconate | 6.6 g |
| Aluminum Sulfate | 25.3 g |
| pH (adjusted with sulfuric acid or sodium hydroxide) | 4.85 |
| Water to make | 1 liter |

(2) Evaluation of Contrast of Image and $D_{max}$:

The slope of a straight line linking a point, fog+density 0.3, to another point, fog+density 3.0, in a characteristic curve was defined as an indication (γ) of contrast of an image. That is, $$\gamma=(3.0-0.3)/[\log(\text{exposure amount giving density } 3.0)-(\text{exposure amount giving density } 0.3)]$$

Greater values of γ exhibit harder photographic properties. $D_{max}$ is the value of a density obtained when 3 times exposure amount of that giving density 1.5 is applied.

(3) Evaluation of Dot Quality:

Halftone dots of a light-sensitive material exposed through a contact screen are visually observed with a magnifier, and the evaluation of definition and smoothness were divided into 5 grades. Grade [5] represents the best level in both definition and smoothness, and grade [1] represents the worst level. In light-sensitive materials, levels of which are grade [3] or higher, the definition and smoothness at on/off portions of images allow the materials to be practically used, when the materials undergo scanner exposure.

TABLE 3

| | Sample | Developer | Degree of Hard Gradation (γ) | $D_{max}$ | Dot Quality |
|---|---|---|---|---|---|
| Comparative Example | 1-1 | A | 5.1 | 3.31 | 2 |
| Comparative Example | 1-2 | A | 5.3 | 3.77 | 2 |
| Comparative Example | 1-3 | A | 5.0 | 3.63 | 2 |
| Present Invention | 1-4 | A | 13.7 | 5.16 | 5 |
| Present Invention | 1-5 | A | 19.2 | 5.41 | 5 |
| Present Invention | 1-6 | A | 14.4 | 5.19 | 5 |
| Present Invention | 1-7 | A | 12.2 | 5.11 | 5 |
| Comparative Example | 1-1 | B | 5.3 | 3.43 | 2 |
| Comparative Example | 1-2 | B | 5.4 | 3.49 | 2 |
| Comparative Example | 1-3 | B | 5.2 | 3.40 | 2 |
| Present Invention | 1-4 | B | 11.5 | 5.05 | 4 |
| Present Invention | 1-5 | B | 14.0 | 5.21 | 5 |
| Present Invention | 1-6 | B | 12.1 | 5.13 | 5 |
| Present Invention | 1-7 | B | 11.3 | 4.98 | 4 |
| Comparative Example | 1-1 | C | 5.5 | 3.43 | 2 |
| Comparative Example | 1-2 | C | 5.8 | 3.56 | 2 |
| Comparative Example | 1-3 | C | 5.1 | 3.25 | 2 |
| Comparative Example | 1-4 | C | 5.7 | 3.40 | 2 |
| Comparative Example | 1-5 | C | 5.5 | 3.35 | 2 |
| Comparative Example | 1-6 | C | 5.8 | 3.44 | 2 |
| Comparative Example | 1-7 | C | 5.3 | 3.21 | 2 |
| Comparative Example | 1-1 | D | 5.0 | 3.08 | 2 |
| Comparative Example | 1-2 | D | 6.2 | 3.71 | 2 |
| Comparative Example | 1-3 | D | 5.4 | 3.22 | 2 |
| Comparative Example | 1-4 | D | 6.5 | 3.75 | 2 |
| Comparative Example | 1-5 | D | 7.2 | 3.77 | 2 |
| Comparative Example | 1-6 | D | 6.6 | 3.51 | 2 |
| Comparative Example | 1-7 | D | 6.3 | 3.48 | 2 |

Results

As is apparent from the results of Table 3, combinations of the light-sensitive materials with the developers of the present invention can give images having high level of high contrast, high $D_{max}$, and good dot quality. Therefore the light-sensitive materials for an Ar laser scanner having hard photographic properties can be obtained even if they are treated with the developers of low pH, namely, pH 9.8.

EXAMPLE 2

The same test as in Example 1 was carried out, except that Compound 14 used as the nucleating agent in Example 1 was replaced by Compound 30, 32 and 21. As a result, the same good results as in Example 1 were obtained in the combination of the present invention.

EXAMPLE 3

Preparation of Silver Halide Photographic Materials

Preparation of Emulsion:

Emulsion B was prepared according to the following method.

[Emulsion B]

An emulsion was prepared in the same manner as that of Emulsion A, except that chemical sensitization was conducted so as to obtain an optimum sensitivity at 60° C. by adding a selenium sensitizer having the following formula in an amount of 1 mg per mol of silver, sodium thiosulfate in an amount of 1 mg, and chloroauric acid in an amount of 4 mg.

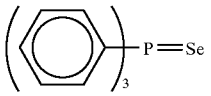

Preparation of Coating Samples:

Samples were prepared in the same manner as that of Example 1, except that the sensitizing dyes used in the EM layer of Example 1 were replaced by the following Compound (S-3) in an amount of $2.1\times10^{-4}$ mol per mol of silver, and that either Emulsion A described in Example 1 or Emulsion B prepared according to the above-mentioned formulation was employed as an emulsion for this EM layer.

(S-3)

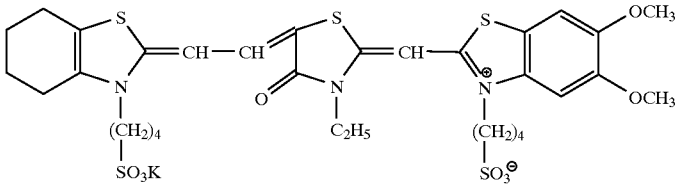

Evaluation of Photographic Performance

The above-mentioned samples were exposed to xenon flash light having an emission time of $10^{-6}$ sec through a step wedge via an interference filter having a peat at 633 nm. The exposed samples were developed with Developers A to D at 35° C. for 30 sec, fixed (similarly to Example 1), washed, and then dried.

As a result, only combinations of the light-sensitive materials with the developers of the present invention gave high level of high contrast, high $D_{max}$, and good dot quality.

EXAMPLE 4

Preparation of Silver Halide Photographic Materials

Samples were prepared in the same manner as that of Example 2, except that the sensitizing dyes used in the EM layer of Example 2 were replaced by the following Compound (S-5).

(S-5)

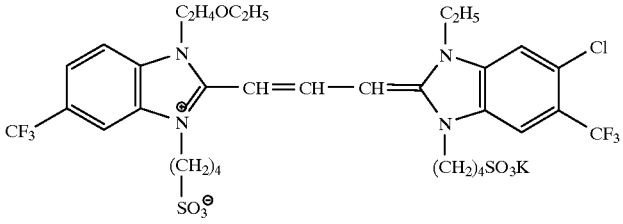

Evaluation of Photographic Performance

The above-mentioned samples were exposed to tungsten light of 3200° K through a step wedge, developed with Developers A to D described in Example 1 respectively at 35° C. for 30 sec, fixed, washed, and then dried. GR-F1 (manufactured by Fuji Photo Film Co., Ltd.) was used as a fixer.

Similarly to Example 1, only combinations of the light-sensitive materials with the developers of the present invention gave high level of high contrast and high $D_{max}$.

EXAMPLE 5

Preparation of Silver Halide Photographic Materials

Preparation of Emulsion:

Emulsion C was prepared according to the following method.

[Emulsion C]

An aqueous solution of silver nitrate and an aqueous solution of sodium chloride were simultaneously mixed with an aqueous solution of gelatin kept at 40° C. in the presence of $NH_4RhCl_6$ in an amount of $5.0\times10^{-6}$ mol per mol of silver. According to a method well-known in one skilled in the art, soluble salt was then removed from the resulting mixture, and further 2-methyl-4-hydroxy-1,3,3a,7-tetrazaindene was added as a stabilizing agent without chemical ripening. This emulsion was a monodispersion emulsion of cubic crystals having an average grain size of 0.2 $\mu$m.

Preparation of Coating Samples:

A hydrazine derivative, Compound 21, in an amount of $1.8\times10^{-3}$ mol per mol of silver was added to the emulsion, and further, the following Nucleating agent (A-2) in an amount of $1\times10^{-3}$ mol per mol of silver was added thereto.

(A-2)

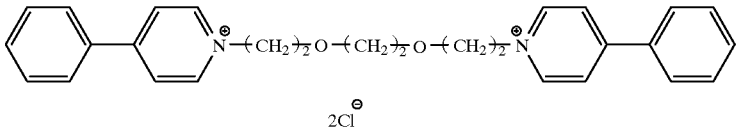

Further, a polyethyl acrylate latex in an amount of 30% by weight as a solid component based on gelatin and 1,3-di (vinylsulfonyl)-2-propanol as a hardener were added, and the resulting emulsion was applied to a polyester support so that the coating amount of silver is 3.8 g/m$^2$. Gelatin coated was 1.8 g/m$^2$. Similarly to Example 1, a PC layer and an OC layer were provided on this layer.

A backing layer and a protective backing layer each having the following respective compositions were formed on the support used in this example. The swelling rate of the backing layer side was 110%.

(Backing Layer)

| | |
|---|---|
| (Backing Layer) | |
| Gelatin | 170 mg/m$^2$ |
| Sodium Dodecylbenzenesulfonate | 32 mg/m$^2$ |
| Sodium Dihexyl-α-sulfosuccinate | 35 mg/m$^2$ |
| $SnO_2$/Sb (Weight Ratio 9/1, Average Particle Size 0.25 μm) | 318 mg/m$^2$ |
| (Protective Backing Layer) | |
| Gelatin | 2.7 g |
| Silicon Dioxide (Matting Agent, Average Particle Size 3.5 μm) | 26 mg/m$^2$ |
| Sodium Dihexyl-α-sulfosuccinate | 20 mg/m$^2$ |
| Sodium Dodecylbenzenesulfonate | 67 mg/m$^2$ |
| $C_8F_{17}SO_2N(C_3H_7)—(CH_2CH_2O)_n—(CH_2)_4—SO_3Li$ | 5 mg/m$^2$ |
| Dye A 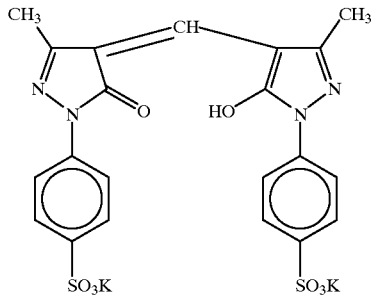 | 190 mg/m$^2$ |
| Dye B 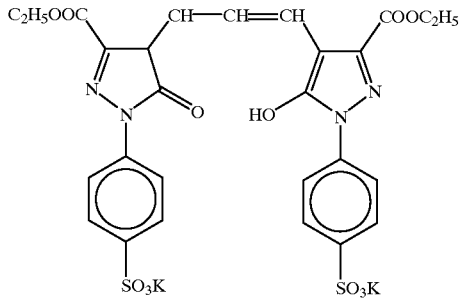 | 32 mg/m$^2$ |
| Dye C 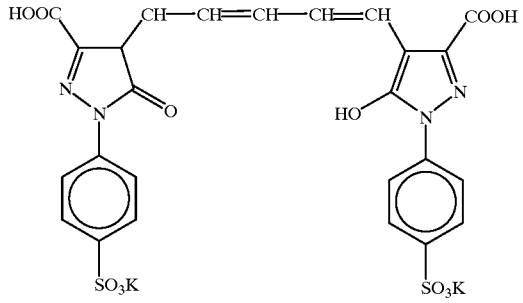 | 59 mg/m$^2$ |

-continued

| | |
|---|---|
| Ethyl Acrylate Latex (Average Particle Size 0.05 μm) | 260 mg/m$^2$ |
| 1,3-Divinylsulfonyl-2-propanol | 149 mg/m$^2$ |

Evaluation of Photographic Performance (1) Exposure and Development:

The samples thus prepared were exposed through a step wedge by use of a P-627FM Bright Room type Printer (manufactured by Dainippon Screen Mfg. Co., Ltd). The exposed samples were developed with developers A to D described in Example 1 at 38° C. for 20 sec, fixed with the same fixer as that of Example 1, washed, and then dried by use of an automatic processor FG710NH (manufactured by Fuji Photo Film Co., Ltd).

(2) Evaluation of Contrast of Image:

Evaluation was carried out in the same manner as in Example 1.

Result

Similarly to Example 1, only combinations of the light-sensitive materials with the developers of the present invention gave high level of high contrast and high $D_{max}$.

While the invention has been described in detail and with reference to specific embodiments thereof, it will be apparent to one skilled in the art that various changes and modifications can be made therein without departing from the spirit and scope thereof.

What is claimed is:

1. A method for forming an image, comprising the steps of:

imagewise-exposing a silver halide photographic material comprising a support having thereon a silver halide emulsion layer, wherein the emulsion layer or other hydrophilic colloid layer contains a hydrazine derivative as a nucleating agent and contains at least one compound represented by formula (A) in amount of from $1\times10^{-4}$ to 1 mol per mol of silver halide; and then developing the exposed photographic material with a developer having a pH of 9.0 to 11.0, the developer containing an ascorbic acid type developing agent and a superadditive auxiliary developing agent and does not substantially contain a dihydroxybenzene type developing agent:

(A)

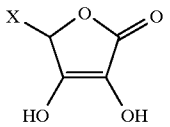

wherein X represents a hydrogen atom, an aryl group, a heterocyclic group, or a group represented by formula (B):

(B)

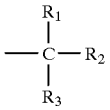

wherein each of $R_1$, $R_2$ and $R_3$ may be the same or different, and each represents a hydrogen atom or a group other than a hydroxyl group.

2. The method for forming an image as claimed in claim 1, wherein said compound represented by formula (A) is present in said emulsion layer or other hydrophilic colloid layer in an amount from $1\times10^{-3}$ to 0.5 mol per mol of silver halide.

3. The method for forming an image as claimed in claim 1, wherein said compound represented by formula (A) is a compound represented by formula (C):

(C)

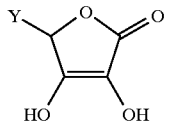

wherein Y represents a group represented by formula (D):

(D)

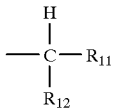

wherein each of $R_{11}$ and $R_{12}$ may be the same or different and each represents a hydrogen atom, an alkyl group, an alkoxyl group, an acyloxy group or an oxycarbonyl group.

4. The method for forming an image as claimed in claim 1, wherein said compound represented by formula (A) is a compound represented by formula (E):

(E)

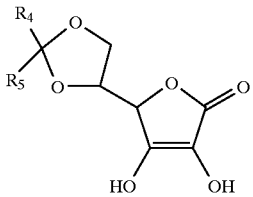

wherein each of $R_4$ and $R_5$ may be the same or different and each represents a hydrogen atom, an alkyl group, an aryl group, or an alkenyl group; and the alkyl groups represented by $R_4$ and $R_5$ may combine to form a cyclic structure.

5. The method for forming an image as claimed in claim 1, wherein said hydrazine derivative is a compound represented by formula (I):

$$R_1\text{—NHNH—}G_1R_2 \quad \text{(I)}$$

wherein $R_1$ represents an aliphatic group, an aromatic group, or a heterocyclic group which may be substituted; $G_1$ represents a group selected from the group consisting of —CO—, —$SO_2$—, —SO—, —COCO—, thiocarbonyl, iminomethylene, and —P(O)($R_3$)—; $R_2$ represents a hydrogen atom or a blocking group; and $R_3$ has the same meaning as defined as $R_2$.

6. The method for forming an image as claimed in claim 1, wherein said silver halide photographic material contains an onium salt.

7. The method for forming an image as claimed in claim 6, wherein said onium salt is represented by formulas (AI), (AII), (AIII) or (AIV):

(AI)

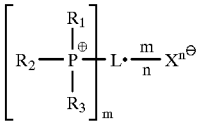

wherein $R_1$, $R_2$ and $R_3$ each represents an alkyl group, a cycloalkyl group, an aryl group, an alkenyl group, a cycloalkenyl group, or a heterocyclic group which may further have a substituent group; m represents an integer of 1 to 4; L represents an m-valent organic group, of which the carbon atom is linked to the phosphorus atom; n represents an integer of 1 to 3; and X represents an n-valent anion and may be linked to L (AII)

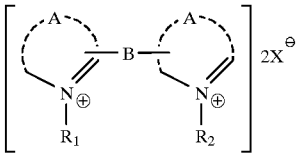

-continued (AIII)

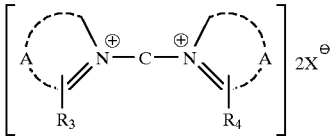

(AIV)

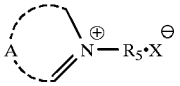

wherein A represents an organic residual group for completing a heterocycle; B and C each represents a divalent group; $R_1$ and $R_2$ each represents an alkyl group or an aryl group; $R_3$ and $R_4$ each represents a hydrogen atom or a substituent group; $R_5$ represents an alkyl group; X represents an anion, but when the compound is an inner salt, X is dispensable.

8. The method for foming an image as claimed in claim 1, wherein said superadditive auxiliary developing agent is a p-aminophenol.

* * * * *